US007836613B2

(12) United States Patent
Koch et al.

(10) Patent No.: US 7,836,613 B2
(45) Date of Patent: Nov. 23, 2010

(54) BLADE ADJUSTMENT APPARATUS

(75) Inventors: Timothy G. Koch, Slinger, WI (US); Robert N. Gamble, II, Watertown, WI (US); Jacob R. Brehmer, Hartford, WI (US)

(73) Assignee: Sno-Way International, Inc., Hartford, WI (US)

( * ) Notice: Subject to any disclaimer, the term of this patent is extended or adjusted under 35 U.S.C. 154(b) by 0 days.

(21) Appl. No.: 12/485,351

(22) Filed: Jun. 16, 2009

(65) Prior Publication Data

US 2009/0308623 A1 Dec. 17, 2009

Related U.S. Application Data

(60) Provisional application No. 61/073,241, filed on Jun. 17, 2008, provisional application No. 61/073,227, filed on Jun. 17, 2008, provisional application No. 61/073,231, filed on Jun. 17, 2008, provisional application No. 61/073,248, filed on Jun. 17, 2008, provisional application No. 61/073,252, filed on Jun. 17, 2008.

(51) Int. Cl.
*E01H 5/04* (2006.01)

(52) U.S. Cl. ..... 37/231

(58) Field of Classification Search ..... 37/231, 37/232, 234, 235, 236, 266, 270; 172/810, 172/811, 815, 817

See application file for complete search history.

(56) References Cited

U.S. PATENT DOCUMENTS

| | | | |
|---|---|---|---|
| 509,811 | A | 11/1893 | Jones |
| 731,419 | A | 6/1903 | Wykoff |
| 956,896 | A | 5/1910 | Gross |
| 1,453,811 | A | 5/1923 | Starkweather |
| 1,812,186 | A | 6/1931 | Wood |
| 1,853,940 | A | 4/1932 | Soule et al. |
| 2,059,431 | A | 8/1934 | Barrett et al. |
| RE20,125 | E | 10/1936 | Frink |
| 2,162,635 | A | 6/1939 | Peereboom |
| 3,157,099 | A | 11/1964 | Ulrich |
| 3,378,084 | A | 4/1968 | Ulrich |
| 3,410,008 | A | 11/1968 | Standfuss |
| 3,432,949 | A | 3/1969 | Glesmann |
| 3,436,847 | A | 4/1969 | Grimes |
| 3,466,766 | A | 9/1969 | Kahlbacher |
| 3,526,979 | A | 9/1970 | Ladewski |
| 3,851,894 | A | 12/1974 | St. Pierre |
| 3,881,261 | A | 5/1975 | Lavoie |
| 3,898,753 | A | 8/1975 | Kinnunen |
| 3,987,562 | A | 10/1976 | Deen et al. |
| 4,074,448 | A | 2/1978 | Niemela |
| 4,099,578 | A | 7/1978 | Stevens |
| 4,159,584 | A | 7/1979 | Niemela |
| 4,436,477 | A | 3/1984 | Lenertz et al. |
| 4,658,519 | A | 4/1987 | Quenzi |
| 4,731,942 | A | 3/1988 | Eberle |
| 4,843,744 | A | 7/1989 | Jansen |
| 4,905,387 | A | 3/1990 | Street |
| 4,962,599 | A | 10/1990 | Harris |

(Continued)

*Primary Examiner*—Robert E Pezzuto
(74) *Attorney, Agent, or Firm*—Reinhart Boerner Van Deuren s.c.

(57) ABSTRACT

A blade adjustment apparatus for a V-plow is provided. A plow tower and a tower adjustment assembly pivotally coupled to the plow tower serve to maintain a lower edge of at least one V-plow blade in a substantially horizontal relationship to a working surface.

24 Claims, 17 Drawing Sheets

U.S. PATENT DOCUMENTS 5,092,409 A 3/1992 Defrancq
5,195,261 A 3/1993 Vachon
5,329,708 A 7/1994 Segorski et al.
5,392,864 A 2/1995 Lindenmuth
5,511,328 A 4/1996 Fingerer et al.
5,568,694 A 10/1996 Capra et al.
5,638,618 A 6/1997 Niemela et al.
5,819,444 A 10/1998 Desmarais
5,829,174 A 11/1998 Hadler et al.
5,894,688 A 4/1999 Struck et al.
5,924,223 A 7/1999 Hone, Jr.
5,960,569 A 10/1999 Molstad
6,035,944 A 3/2000 Neuner et al.
6,044,579 A 4/2000 Hadler et al.
6,088,937 A 7/2000 DeClementi et al.
6,108,946 A 8/2000 Christy
6,145,222 A 11/2000 Curtis
6,151,808 A 11/2000 Curtis
6,154,986 A 12/2000 Hadler et al.
6,178,669 B1 1/2001 Quenzi et al.
6,209,231 B1 4/2001 Curtis
6,240,659 B1 6/2001 Curtis et al.
6,253,470 B1 7/2001 Depies et al.
6,314,666 B1 11/2001 Klemenhagen et al.
6,363,629 B1 4/2002 Curtis
6,408,549 B1 6/2002 Quenzi et al.
6,467,199 B1 10/2002 Christy
6,526,677 B1 3/2003 Bloxdorf et al.
6,557,275 B2 5/2003 Curtis
6,594,924 B2 7/2003 Curtis
6,615,513 B2 9/2003 Quenzi et al.
6,618,964 B2 9/2003 Kost et al.
6,691,435 B1 2/2004 Schultz et al.
6,711,837 B2 3/2004 Bloxdorf et al.
6,775,933 B2 8/2004 Koch et al.
6,928,757 B2 8/2005 Bloxdorf et al.
6,941,685 B2 9/2005 Goy et al.
6,944,978 B2 9/2005 LeBlond et al.
6,964,121 B2 11/2005 Harris
7,103,995 B2 9/2006 Curtis
7,117,617 B2 10/2006 Kost et al.
7,146,754 B2 12/2006 Schultz et al.
7,228,650 B2 6/2007 Curtis
7,334,357 B1 2/2008 Altheide
7,353,628 B2 4/2008 Potak
7,437,839 B2 10/2008 Christy et al.
7,481,011 B2 1/2009 Nesseth
7,513,069 B1 4/2009 Gamble, II et al.
2004/0088892 A1 5/2004 Kost et al.
2004/0172858 A1 9/2004 Bloxdorf et al.
2005/0039968 A1 2/2005 Lashua
2005/0076543 A1 4/2005 Curtis
2005/0120595 A1 6/2005 Bloxdorf et al.
2005/0144814 A1 7/2005 Potak
2006/0055150 A1 3/2006 Curtis
2007/0051021 A1 3/2007 Kost et al.
2008/0073090 A1 3/2008 Harris
2008/0115392 A1 5/2008 Musso et al.

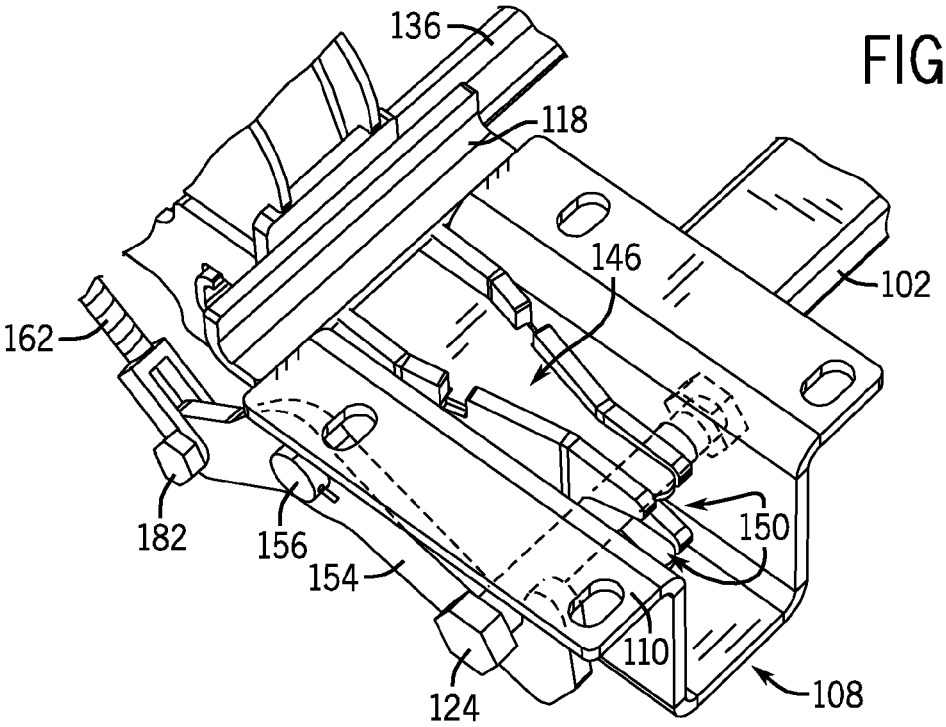
FIG. 10
FIG. 11
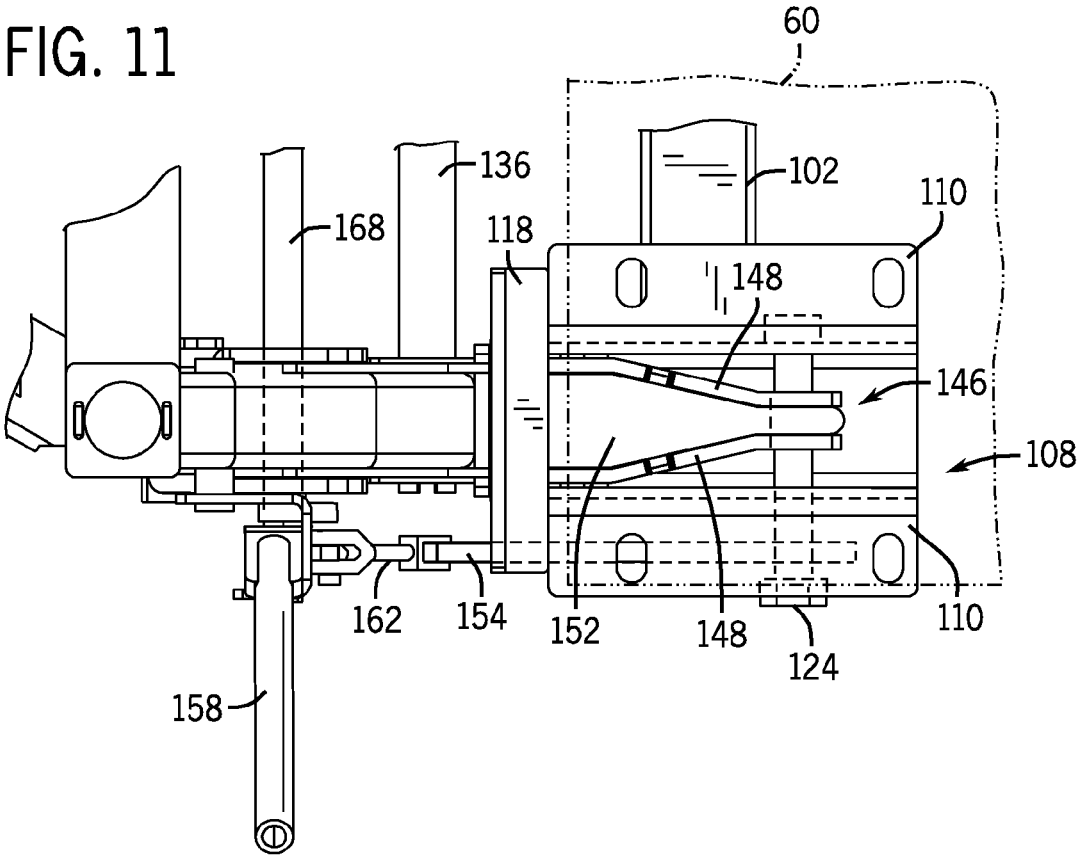

FIG. 19
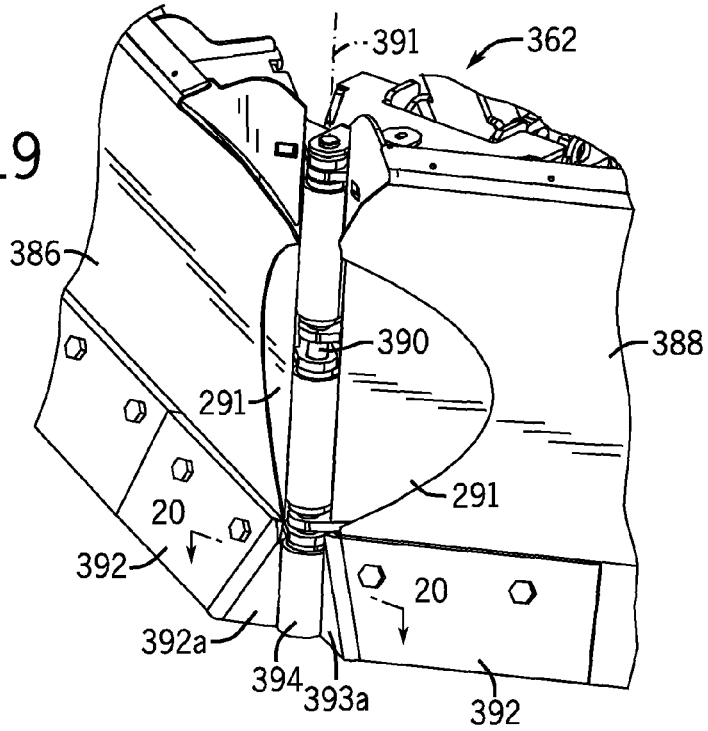
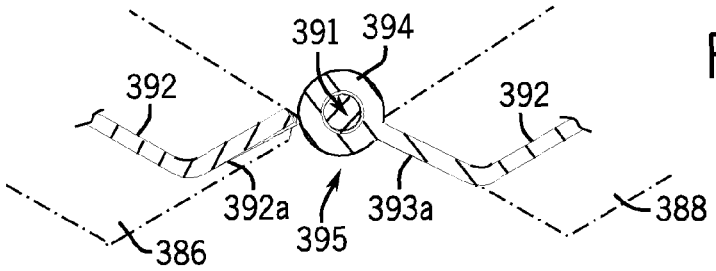
FIG. 20
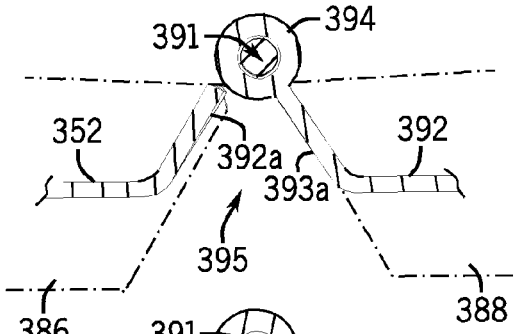
FIG. 21
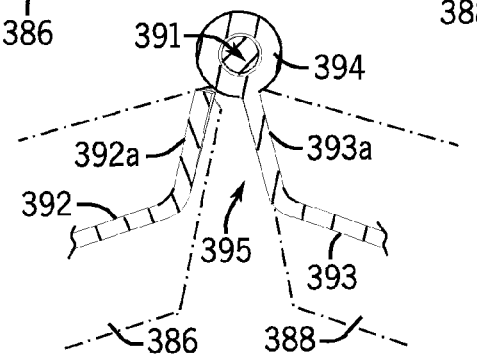
FIG. 22

BLADE ADJUSTMENT APPARATUS

CROSS-REFERENCE TO RELATED APPLICATIONS

This application claims the benefit of U.S. Provisional Application No. 61/073,241, filed Jun. 17, 2008. This application is related to U.S. patent application Ser. No. 12/140,509, U.S. Provisional Patent Application No. 61/073,227, U.S. Provisional Patent Application No. 61/073,231, U.S. Provisional Patent Application No. 61/073,248, U.S. Provisional Patent Application No. 61/073,252, U.S. patent application Ser. No. 12/140,903, U.S. patent application Ser. No. 12/140,881, U.S. patent application Ser. No. 12/140,466, U.S. patent application Ser. No. 12/140,893, U.S. patent application Ser. No. 12/140,886, U.S. patent application Ser. No. 12/140,732, U.S. patent application Ser. No. 12/140,671, and U.S. Provisional application Ser. No. 12/140,635, each filed Jun. 17, 2008 and each incorporated herein by reference thereto.

BACKGROUND OF THE INVENTION

Field of the Invention

The present invention relates generally to material handling equipment, and more particularly to a plow with a hitch mechanism configured to be easily and quickly coupled to a vehicle and position V-plow blades relative to a work surface.

It is known that plows, for example snow plows, are bolted to supports which are typically welded to the chassis of a vehicle, for example a truck. It is also known that a plow support can be bolted to the chassis of a vehicle. Since plows typically weigh hundreds of pounds, positioning the plow for attachment to the vehicle can be difficult. It is particularly difficult to maneuver a snow plow in the cold and snow of winter.

It is also known to provide a V-Plow in which two blade segments are positioned in a V-shape with the blade segments swept to the rear. Where the blade segments come close together a gap exists through which material, such as snow, can move. It is known, for example, to overlap the blade segments or place a flexible covering in front of the gap. Such configurations are not satisfactory and need replacement or high maintenance activity.

Accordingly, it is desirable to provide a plow hitch mounting mechanism which is easy to maintain and that the process of connecting and disconnecting the plow to or from the vehicle is simple and easy to use by one person without assistance. It is also desirable to provide a V-plow having a minimum gap between the two V-plow segments and providing an adjustment apparatus to facilitate maintaining the blade bottom edges in horizontal alignment along their length.

The apparatus of the present disclosure must also be of construction which is both durable and long lasting, and it should also require little or no maintenance to be provided by the user throughout its operating lifetime. In order to enhance the market appeal of the apparatus of the present disclosure, it should also be of inexpensive construction to thereby afford it the broadest possible market. Finally, all of the aforesaid advantages should be achieved without incurring any substantial relative disadvantage.

SUMMARY OF THE INVENTION

The disadvantages and limitations of the background art discussed above are overcome by the present invention.

There is provided a snow plow which includes a hitch frame nose assembly configured to a vehicle. The hitch frame nose assembly includes a chassis coupler secured at each end of a chassis tube with each chassis coupler including a traverse pin is configured to attach to the vehicle chassis. A plow frame having a front portion and a rear portion is coupled to a plow tower configured to support each of a first V-plow blade and a second V-plow blade pivotably coupled to the plow tower with a horizontal pivot pin. The plow tower is configured to support each of the V-plow blades for movement about a blade vertical pivot pin disposed in each of the first and second V-plow blades and the plow tower. A tower adjustment assembly is coupled to the plow tower and the plow frame, with the tower adjustment assembly configured to adjust the orientation of the two V-plow blades about the horizontal pivot pin. A lift bar assembly is coupled to the rear portion of the plow frame. The lift bar assembly includes a pair of notched members with each notched member aligned with a corresponding chassis coupler and configured to engage the traverse pin in each of the chassis couplers, wherein the snow plow is pivotably coupled to the vehicle. In another embodiment, the tower adjustment assembly includes an adjustment cushion plug positioned within an outer adjustment tube in an operative contact with an inner adjustment positioned within the outer adjustment tube, wherein upon compression of the adjustment cushion plug a force is transmitted to the inner adjustment tube and rotates the plow tower about the horizontal pivot pin.

The apparatus of the present disclosure is of a construction which is both durable and long lasting, and which will require little or no maintenance to be provided by the user throughout its operating lifetime. The apparatus of the present disclosure is also of inexpensive construction to enhance its market appeal and to thereby afford it the broadest possible market. Finally, all of the aforesaid advantages and objectives are achieved without incurring any substantial relative There is further provided an apparatus to position V-plow blades relative to a work surface. A V-plow including a plow frame, a first blade and a second blade is configured with each blade rotable about a horizontal axis. The apparatus to position includes a tower coupled to each of the first and second blades with a horizontal pivot pin coaxial with the horizontal axis. The tower is also coupled to the plow frame, wherein the tower defines a vertical axis. A tower adjustment assembly is coupled to the tower and to the plow frame. The tower adjustment assembly includes an adjustment cushion plug. The adjustment cushion plug is configured to transmit a force through the tower adjustment assembly to rotate the tower about the horizontal axis and move the first and second blade to a horizontal position relative to the work surface.

DESCRIPTION OF THE DRAWINGS

These and other advantages of the present invention are best understood with reference to the drawings, in which:

FIG. 10 is a detail perspective view of a chassis coupler engaged with a notched member of the hitch frame mechanism illustrated in FIG. 3.

FIG. 11 is a top view of the chassis coupler illustrated in FIG. 10.

FIG. 19 is a detail front view of an exemplary embodiment of a pivot for the first and second V-blades illustrated in FIG. 18.

FIG. 20 is a cross-sectional top view of the lower pivot portion along the line 20-20 in FIG. 19 and illustrating the alignment of the first and second V-plow blades in a swept-back position.

FIG. 21 is a cross-sectional top view of the lower pivot portion along the line 20-20 in FIG. 19 and illustrating the alignment of the first and second V-plow blades in a straight line position.

FIG. 22. is a cross-sectional top view of the lower pivot portion along the line 20-20 in FIG. 19 and illustrating the alignment of the first and second V-plow blades in a swept-forward position.

DETAILED DESCRIPTION OF THE EXEMPLARY EMBODIMENTS

There is disclosed a snow plow 50 for mounting on a vehicle 60 with a quick connection/disconnect hitch 70 (more fully described below). The quick connect/disconnect hitch 70 facilitates the easy connection, i.e., without tools and disconnection of the snow plow 50 from the vehicle 60.

Figures 1, 2:
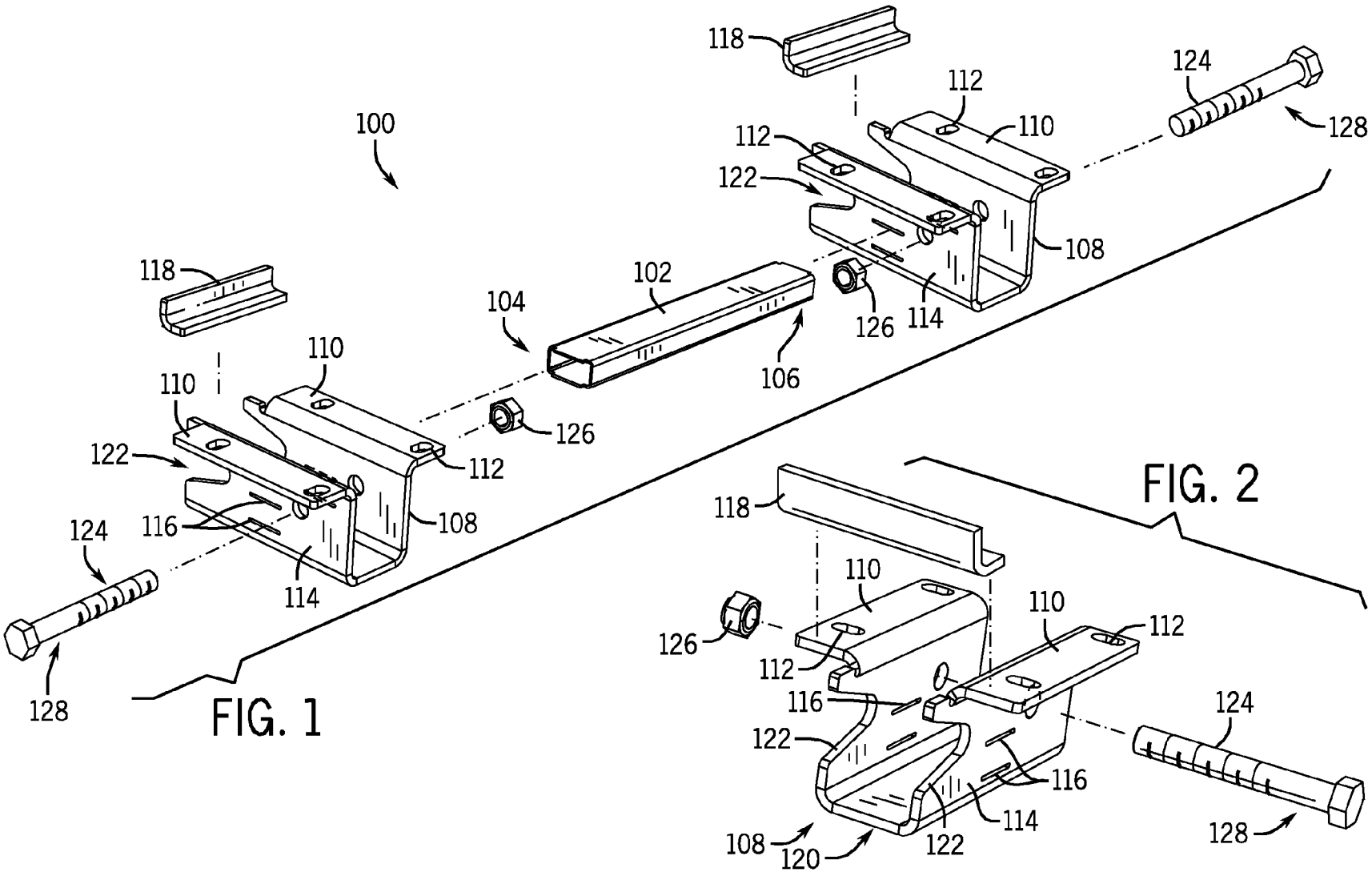
FIG. 1 is an exploded, isometric view of an exemplary embodiment of a hitch frame nose assembly.
FIG. 2 is a detail view of an exemplary embodiment of a chassis coupler of the hitch frame nose assembly illustrated in FIG. 1.

Referring to FIGS. 1 and 2, a hitch frame nose assembly 100 includes a hitch frame tube having a first end 104 and a second end 106. Coupled to each end of the hitch nose tube 102 is a chassis coupler 108. Each chassis coupler 108 mounts to the vehicle chassis 60. In a typical set up, each of the chassis couplers 108 will be secured to a frame member of the vehicle chassis 70 (not shown) by bolting the chassis coupler 108 to the vehicle chassis 60. It is also contemplated that the chassis coupler 108 can be welded to the vehicle chassis 60 as determined by the user of the quick connect/disconnect hitch 70.

Each chassis coupler 108 is a formed U-shaped channel with outward extending flanges. The flanges 110 are configured to provide a mounting surface for the chassis coupler 108 to facilitate coupling of the chassis coupler 108 to the vehicle chassis 60. Each flange 110 defines a plurality of apertures 112 to facilitate bolting of the chassis coupler 108 to the vehicle chassis 60. The apertures 112 may be configured as circles or slots. Each side 114 of each chassis coupler 108 further defines a pair of slots 116 extending longitudinally along and through each side 114 of the chassis coupler 108. The slots 116 facilitate the coupling of the hitch frame tube 102 to each of the chassis couplers 108 comprising the hitch frame nose assembly 100. Each chassis coupler 108 may be provided with slots 116 on each side 114 of the chassis coupler 108 to facilitate manufacturing and assembly by providing commonality of parts. Each chassis coupler 108 is also provided with an end-stop coupled to each of the flanges 110 proximate the front end 120 of the chassis coupler 108. The end-stop 118 assists in positioning the chassis coupler 108 on the vehicle chassis 60. Each chassis coupler 108 also defines a substantially V-shaped notch 122 to accommodate a lock hook pivot more fully described below. Each chassis coupler 108 also includes a traverse pin 124 which extends through both sides 114 of the chassis coupler 108. Traverse pin 124 is secured to the chassis coupler 108 by a nut threadingly fastened to the traverse pin 104. The nut may further be welded to the chassis coupler 108 to further secure the traverse pin 124. A portion 128 of the traverse pin extends beyond the side 114 of the chassis coupler 108 and is configured to engage a locking hook more fully described below.

Figure 3A:
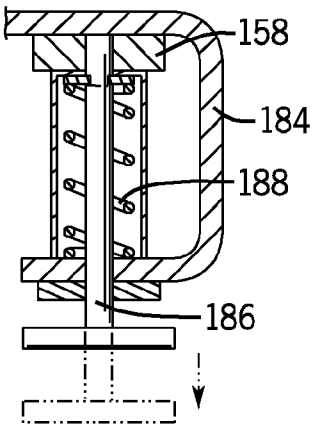
FIG. 3A is a cross-sectional view of an exemplary embodiment of a spring biased retaining pin along the line 3A-3A of FIG. 3.
Figure 3:
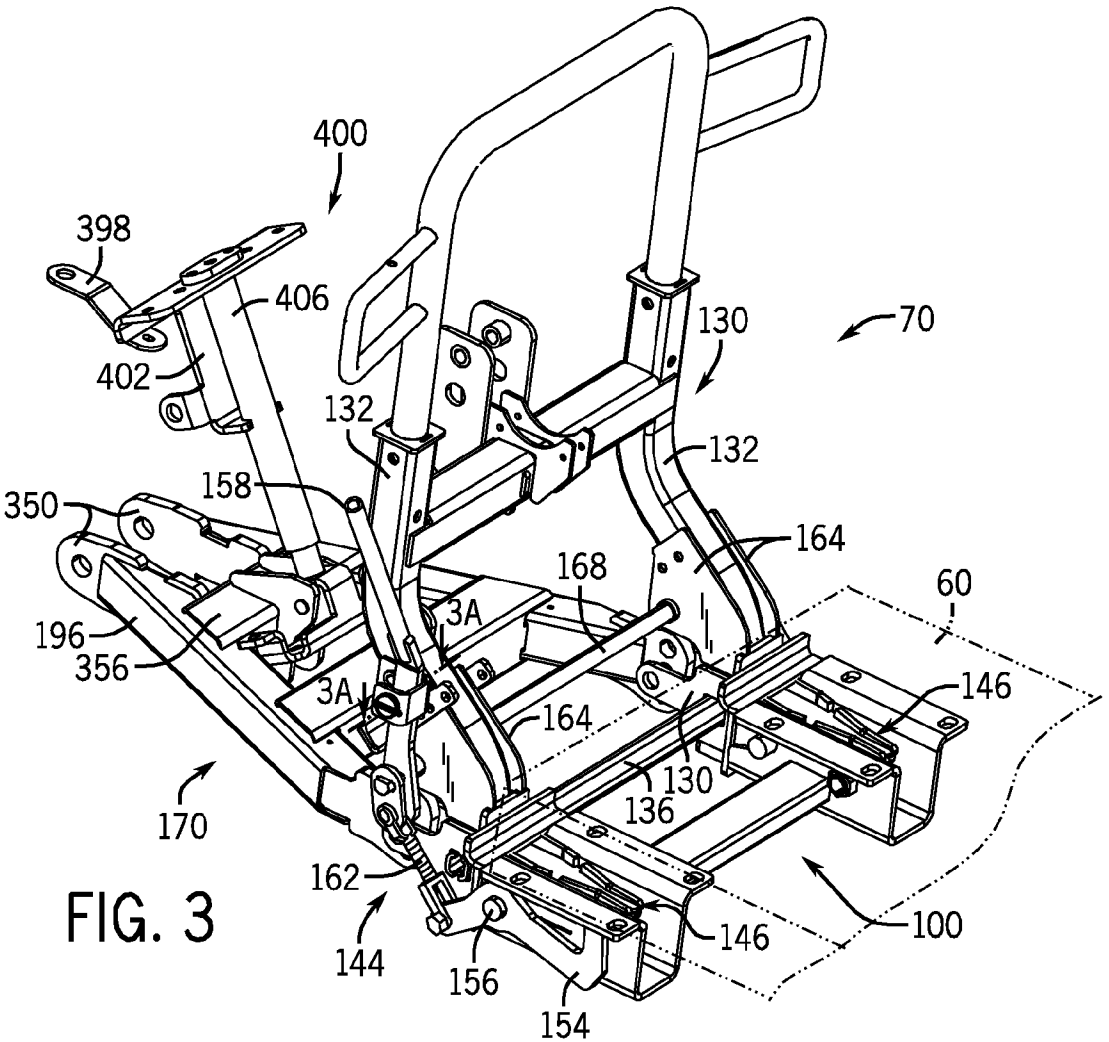
FIG. 3 is an isometric rear view of an exemplary embodiment of a hitch mechanism coupled to a vehicle.

FIG. 3 illustrates an exemplary embodiment of a quick connect/disconnect hitch 70 assembly. The hitch frame nose assembly 100 is coupled to a vehicle chassis 60. Coupled to the hitch frame nose assembly 100 is the lift bar assembly 130 which in turn is coupled to a plow frame 170.

Figure 12:
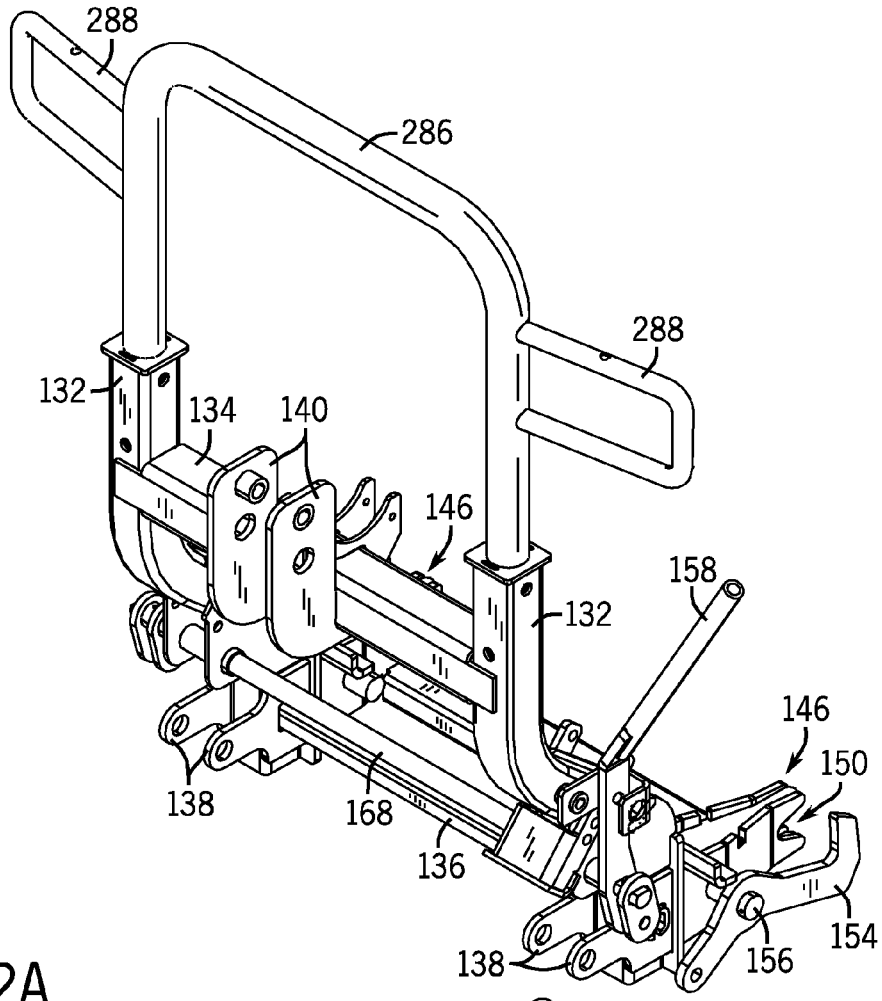
FIG. 12 is an isometric rear view of an exemplary embodiment of a lift bar assembly of the hitch mechanism illustrated in FIG. 3.
Figure 12A:
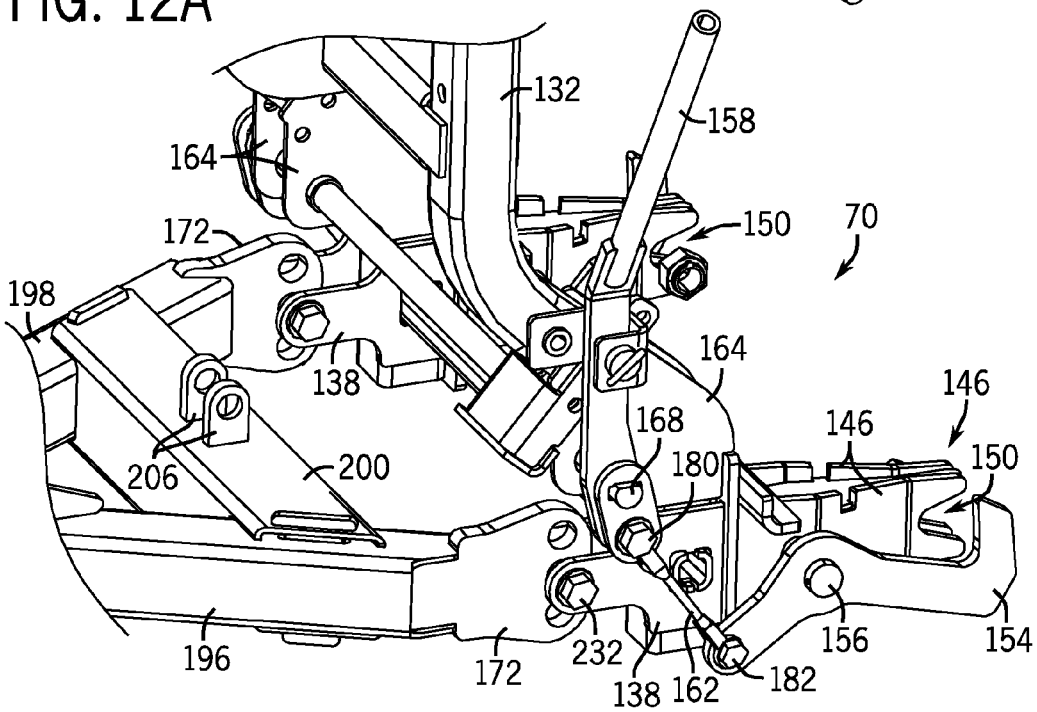
FIG. 12A is a partial view of the lift bar assembly illustrated in FIG. 12, illustrating the lift bar assembly coupled to the rear portion of a plow frame in one of a plurality height adjustment orifices.
Figure 12B:
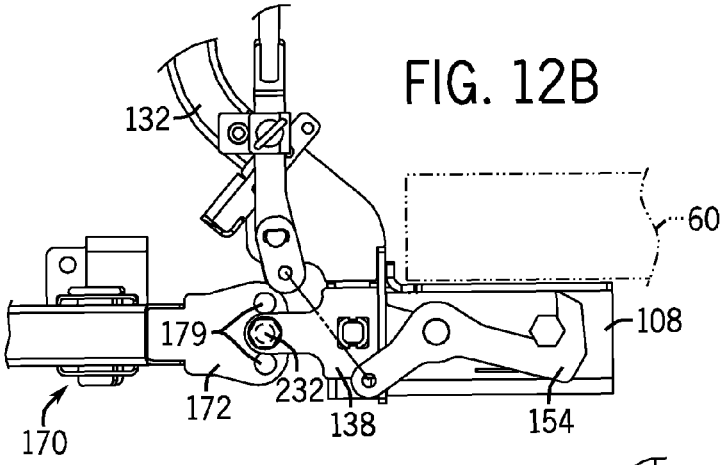
FIG. 12B is a partial side elevation of the hitch mechanism illustrated in FIG. 3.
Figure 12C:
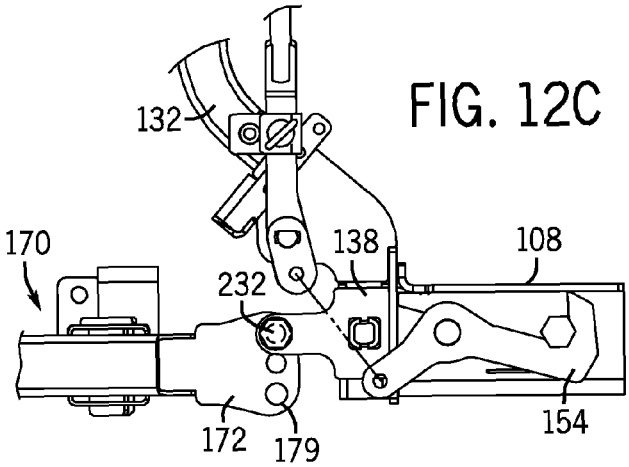
FIG. 12C is a partial side elevation of the hitch mechanism illustrated in FIG. 3 with the lift bar assembly coupled to the plow frame in an alternative height adjustment orifice.

The lift bar assembly 130 includes a pair of lift bar support members 132 maintained in a spaced apart relationship and coupled to a lift bar approximate the top of each lift bar support member 132. A light bar brace 136 approximate the lower end of each lift bar support member 132 facilitates maintenance of the spaced apart relationship of the lift bar support member 132. A pair of lift bar lugs 138 are coupled to each lift bar support member 132 approximate the light bar brace 136. (Also see FIGS. 12 and 12*a*). Coupled to the lift bar 134 are a pair of upper lift cylinder mounts 140 configured to operably secure a power mechanism, for example a lift cylinder 142. Also coupled to the lift bar assembly 130 is a locking mechanism 144.

Figure 4:
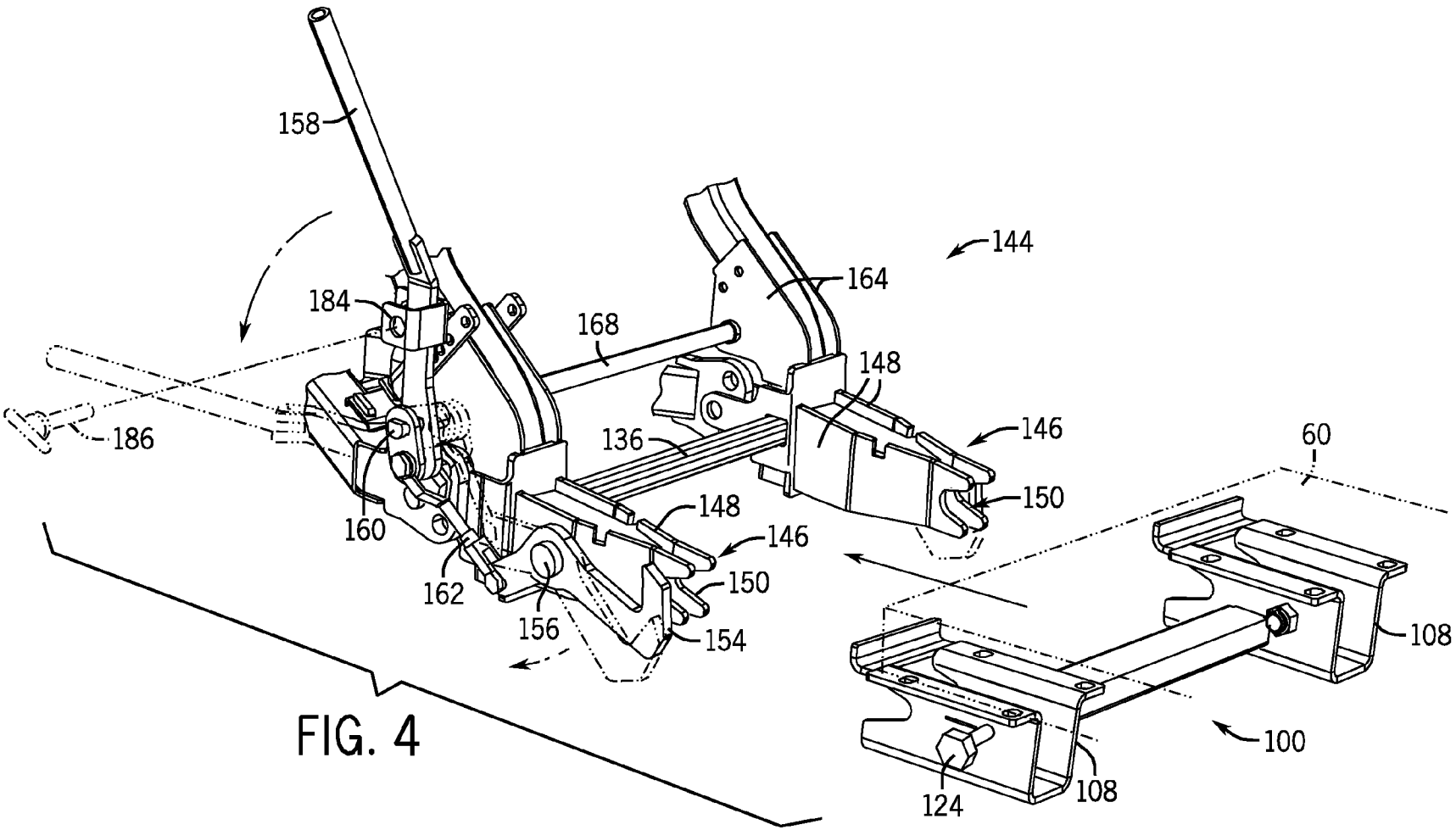
FIG. 4 is an isometric view of the hitch mechanism illustrated in FIG. 3 uncoupled from the hitch frame nose assembly.

Referring to FIG. 4, there is illustrated a hitch frame nose assembly 100 coupled to a vehicle chassis 60 and positioned to receive a locking mechanism 144 of a quick connect/disconnect hitch 70. The locking mechanism 144 includes a pair of notched members 146 coupled to the lift bar assembly 130 and positioned to correspond for engagement with each of the chassis couplers 108 of the hitch frame nose assembly 100.

Each notch member 146 includes a pair of tapered side members 148 with each tapered side member 148 defining a notch 150. Each notch 150 is configured to engage the traverse pin 124 positioned between the two sides 114 of each chassis coupler 108. Each notch member 146 also includes a plate member 152 fastened to the top portion of each of the tapered side members 148, typically by welding a plate member 150 to each tapered side member 148. The plate member provides additional reinforcement for the notch member 146 and defines with the two tapered side members 148 an inverted U-shape assembly. With the notch member 146 engaged with the chassis coupler 108 the pivot for the quick connect/disconnect hitch 70 formed by the engagement of the notch 150 with the traverse pin 124 is enclosed within the two facing u-shaped assemblies.

Each notched member 146 further includes a locking hook 154 pivotally coupled to a hook pivot 156. The hook pivot 156 extends through each of the tapered side members 148 of each notch member 146. The locking hook 154 moves about the hook pivot 156 in response to movement of the hitch locking lever 158 as the hitch locking lever 158 moves about a lever pivot 160. The hitch locking lever 158 is coupled to the locking hook 154 by a lock linkage 162. The operation of the locking mechanism 144 will be explained below.

The orientation of the locking hook 154 and the notch member 146 is such that when the notch member 146 is inserted into the chassis coupler 108 the locking hook is positioned outside of the unshaped chassis coupler 108 and positioned to selectively engage the portion 128 of the traverse pin 124 that extends beyond the side 114 of the chassis coupler 108. It should be understood that there is a locking hook 154 on each of the notch members 146 which engages the traverse pin 124 extending beyond the side 114 of each of the chassis couplers 108 that are part of the hitch frame nose assembly 100. The locking hook 154 locks the lift bar assembly 130 to the hitch frame nose assembly 100.

Locking mechanism 144 also includes a lock support bracket 164 which is coupled to each of the lift bar support members 132. A preferred embodiment provides that a pair of lock support brackets 164 are coupled to each side of the corresponding lift bar support member 132. (FIGS. 3 and 4).

It should be understood that the locking mechanism 144 includes a locking hook 154, hook pivot 156, lock linkage 162 on each outward side of the lift bar assembly 130. On one side of the lift bar assembly 130, the hitch locking lever 158 is coupled to the linkage, and on the other side of the lift bar assembly 130 the lock linkage 162 is coupled to a lock linkage bracket 166. (See FIG. 9). The lock linkage bracket 166 and the hitch locking lever 158 are coupled together by a hitch lock extension rod 168 extending through each of the lock support brackets 164 and each of the lift bar support members 132. The hitch lock lever 158 and the lock linkage bracket 166 are journaled to the hitch lock extension rod 168 by a flat face defined on each end of the hitch lock extension rod 168. (See FIGS. 8 and 9).

Figure 5:
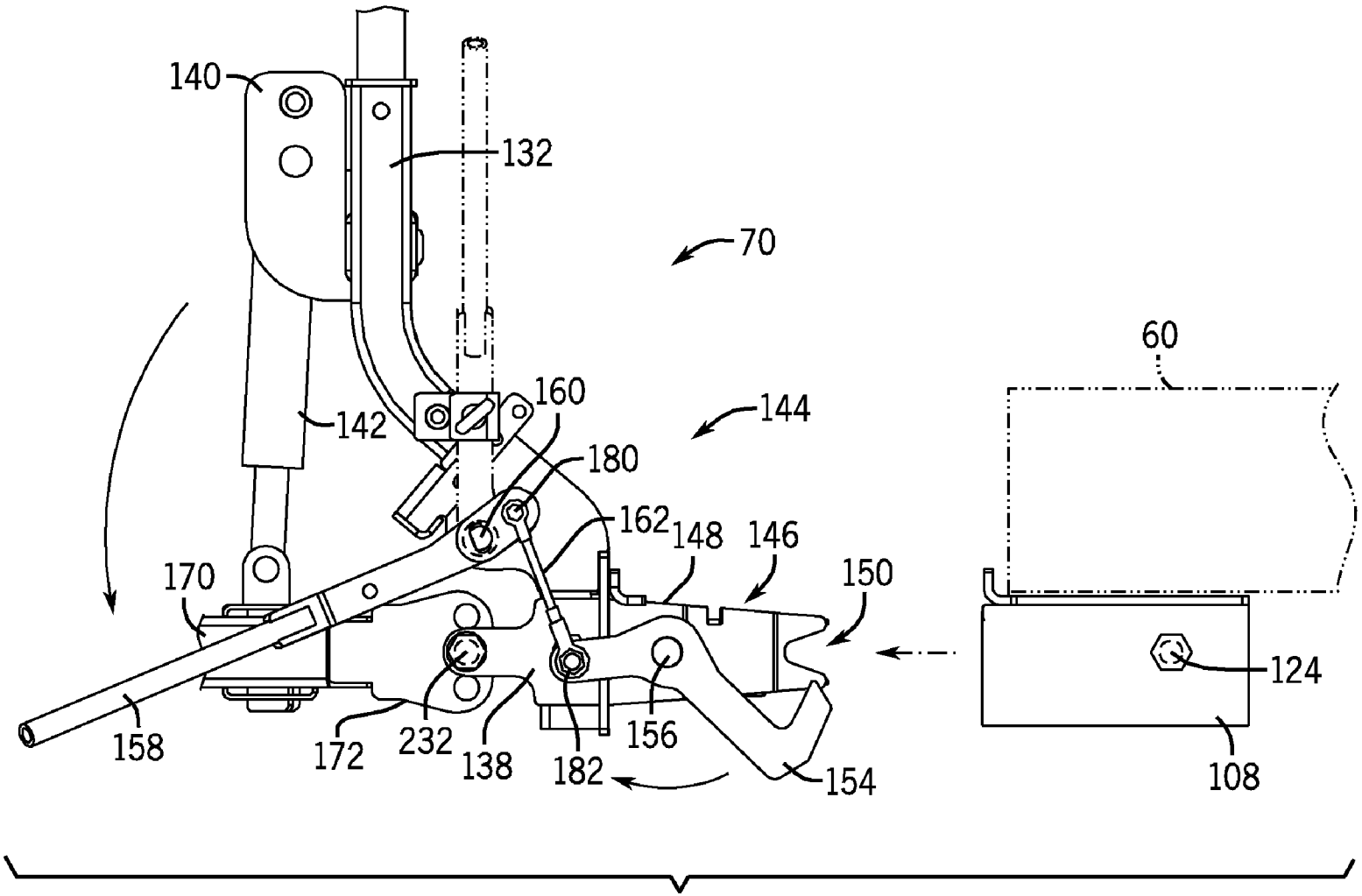
FIG. 5. is a side elevation of the hitch mechanism illustrated on FIG. 4.

The operation of coupling the quick connect/disconnect hitch 70 to the vehicle chassis 60 will now be described with reference to FIGS. 5 through 9. FIG. 5 illustrates an exemplary embodiment of a quick connect/disconnect hitch 70 positioned to engage the hitch frame nose assembly 100 coupled to a vehicle chassis 60. The hitch locking lever 158 is in an unlocked position 174. The movement of the hitch lock lever 158 to the unlocked position 174 rotated the locking hook as illustrated in FIG. 5. The vehicle having a hitch frame nose assembly 100 coupled to the vehicle chassis 60 is moved towards the quick connect/disconnect hitch 70 as indicated by the arrow in FIG. 5.

Figure 6:
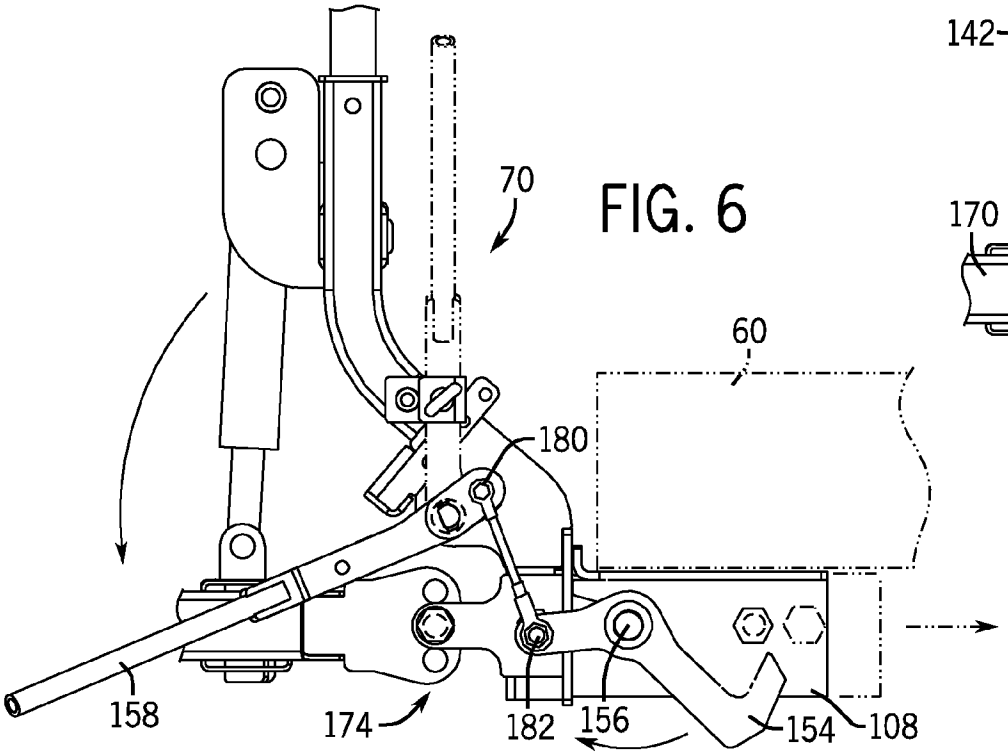
FIG. 6 is a side elevation of the hitch mechanism illustrated in FIG. 3 with the hitch mechanism configured to uncouple from the hitch frame nose assembly.

FIG. 6 illustrates the quick connect/disconnect hitch 70 engaged with the hitch frame nose assembly 100 with each notched member 146 of the lift bar assembly 130 coupled to the traverse pin 124 in each of the chassis couplers 108. Such engagement is illustrated at least in FIGS. 10 and 11. In this position, with the hitch locking lever 158 still in the unlocked position 174 the vehicle can be moved away from the hitch 70 if additional adjustment maneuvers are necessary.

Figure 7:
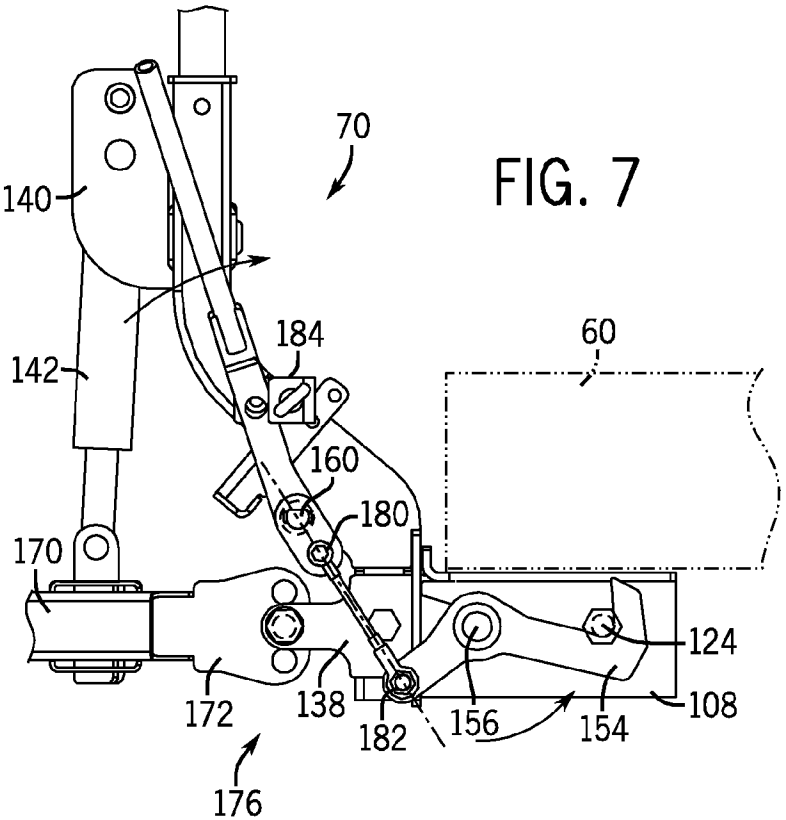
FIG. 7 is side elevation of the hitch mechanism illustrated in FIG. 3 with the hitch mechanism coupled to a chassis coupler of the hitch frame nose assembly and illustrating the hitch locking lever in a first lock position.

FIG. 7 illustrates the locking mechanism 144 in a first locked position 176. In the first locked position 176, the locking hook has moved to engage the traverse pin 124 in each of the chassis couplers 108. In this configuration, the lever pivot 160, the hitch locking lever linkage attachment 180 and the hook linkage attachment 182 are substantially in a straight line as illustrated in FIG. 7.

Figure 8:
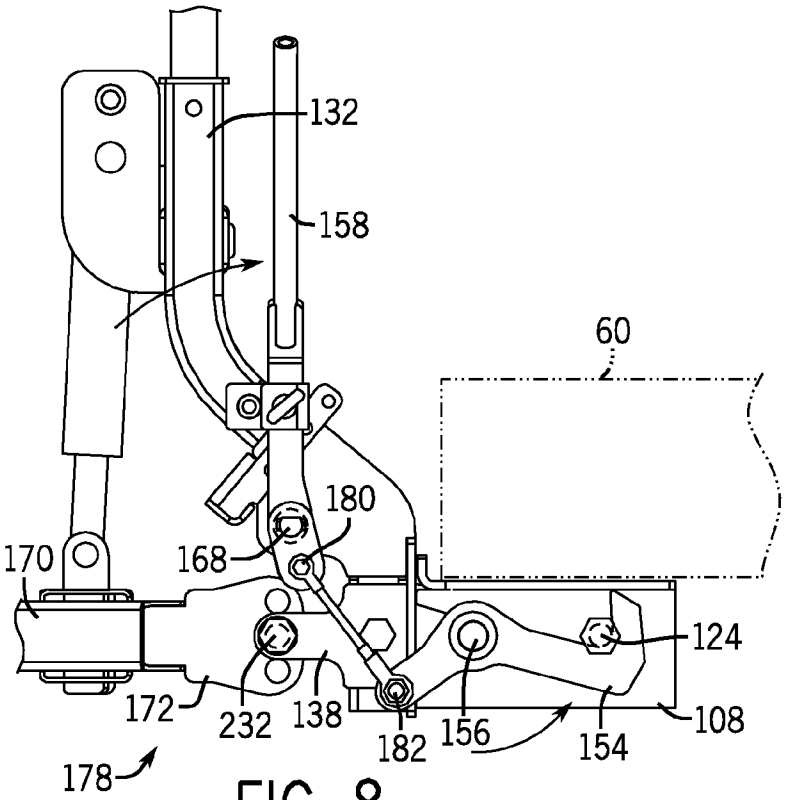
FIG. 8 is a side elevation of the hitch mechanism illustrated in FIG. 7 and illustrating the hitch locking lever in a second lock position.

To complete the locking maneuver of the locking mechanism 144, the hitch locking lever 158 is moved to a second locked position 178 which forces the hitch locking lever 158 to move over center of the lever pivot 160 as illustrated in FIG. 8. The hitch locking lever 158 also is secured in a retaining bracket 184 coupled to a locked support bracket 164. The retaining bracket 184 includes a retaining pin 186 which is biased by a spring 188. The retaining pin 186 engages an orifice defined in the hitch lever locking lever 158 as illustrated in FIG. 3A. It should be understood that other ways of securing the locking lever 158 can be used to prevent the locking lever 158 from inadvertently unlocking the hitch 70.

Figure 9:
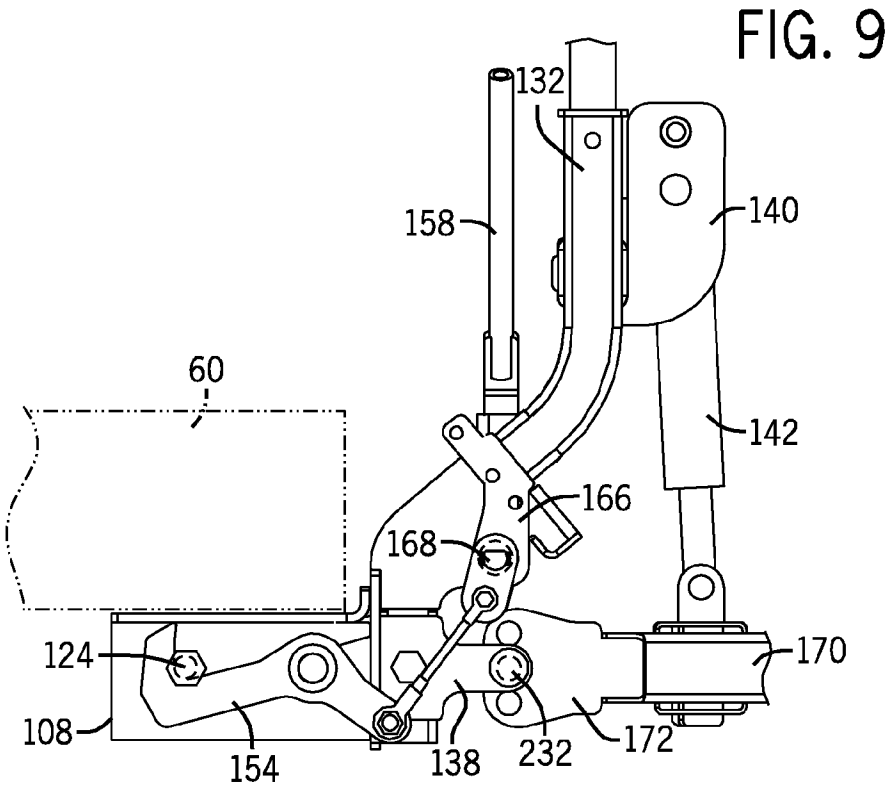
FIG. 9 is a side elevation of another side of the hitch mechanism illustrated in FIG. 8.

As described above, the locking mechanism 144 includes a lock hook 154 on each side of the lift bar assembly 130 and are coupled together to simultaneously operate with movement of the hitch locking lever 158. FIG. 9 illustrates the other side of the locking mechanism 144 illustrated in FIG. 8.

The lift bar assembly 130 is coupled to a plow frame 170. The lift bar assembly 130 is provided with a pair of lift bar lugs 138 coupled to the lift bar brace 136 and to each of the lock support brackets 164 on both sides of the lift bar assembly 130 (see FIG. 12).

A plow frame 170 is configured substantially in the form of a letter A with the plow frame 170 including a front portion 175 and a rear portion 177. The plow frame 170 includes two side member 196, 198 which form the sides of the A-shape with a traverse brace tube 200 coupled to each of the side members 196, 198. A tower traverse brace tube 354 is also coupled to each of the side members 196, 198 and positioned in a spaced apart distance from the traverse brace tube 200 proximate the front portion 175 of the plow frame 170. The side members 196, 198, the tower traverse brace tube 354, and the traverse brace tube 200 are conventional steel square tubing, however, it is contemplated that other cross-section configured tubes, for example circular or triangular, can be used. Coupled to the front portion 175 of the plow frame 170 are a pair of horizontal blade pivot brackets 350. The brackets 350 are coupled to the respective side member 196, 198 and the tower traverse brace tube 354. Each of the brackets 350 defines an orifice 352 configured to receive a horizontal blade pivot pin 370.

Figure 13:
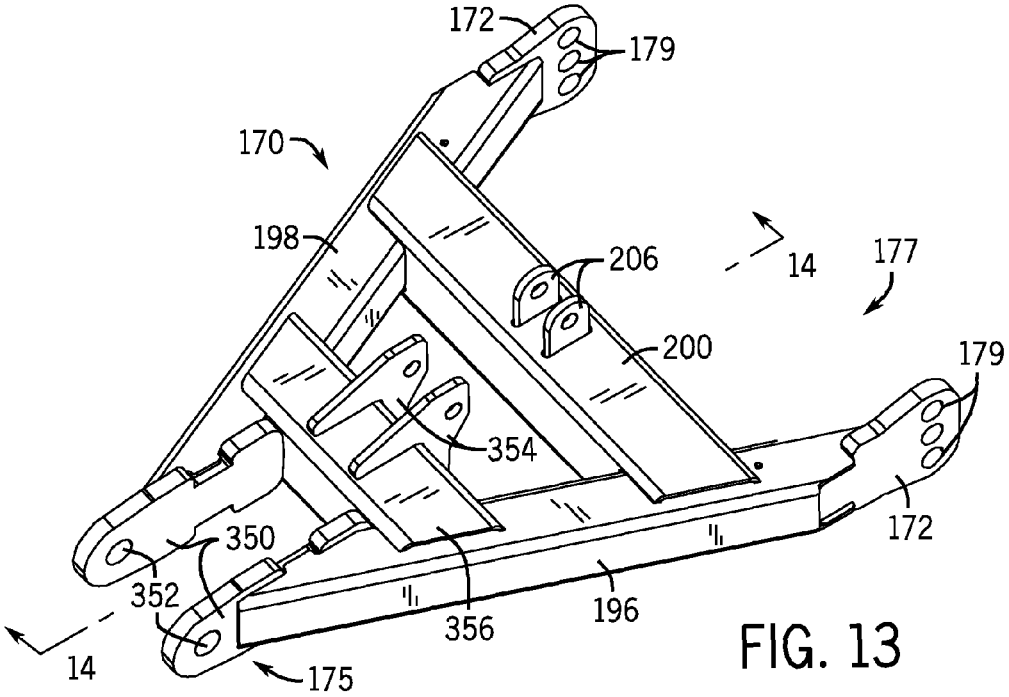
FIG. 13 is an isometric, top, front view of an exemplary embodiment of an A-frame plow frame assembly of the hitch mechanism illustrated in FIG. 3.
Figure 14:
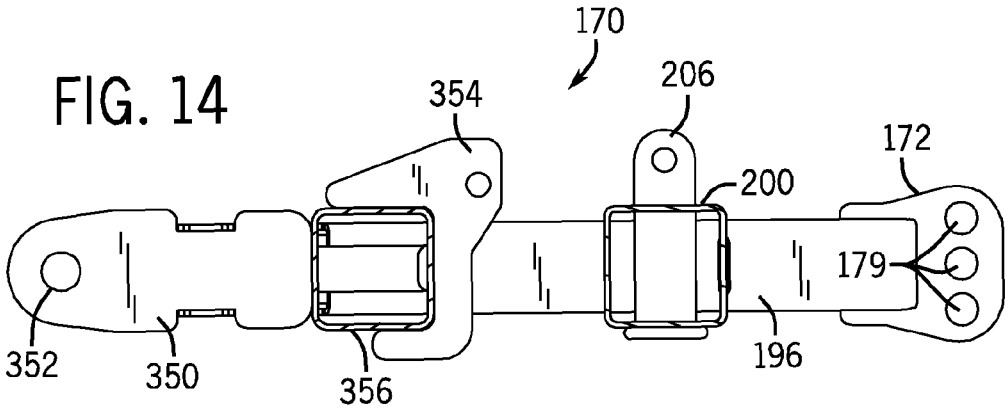
FIG. 14 is a cross sectional view of the plow frame illustrated in FIG. 13 along the line 14-14.
Figure 15:
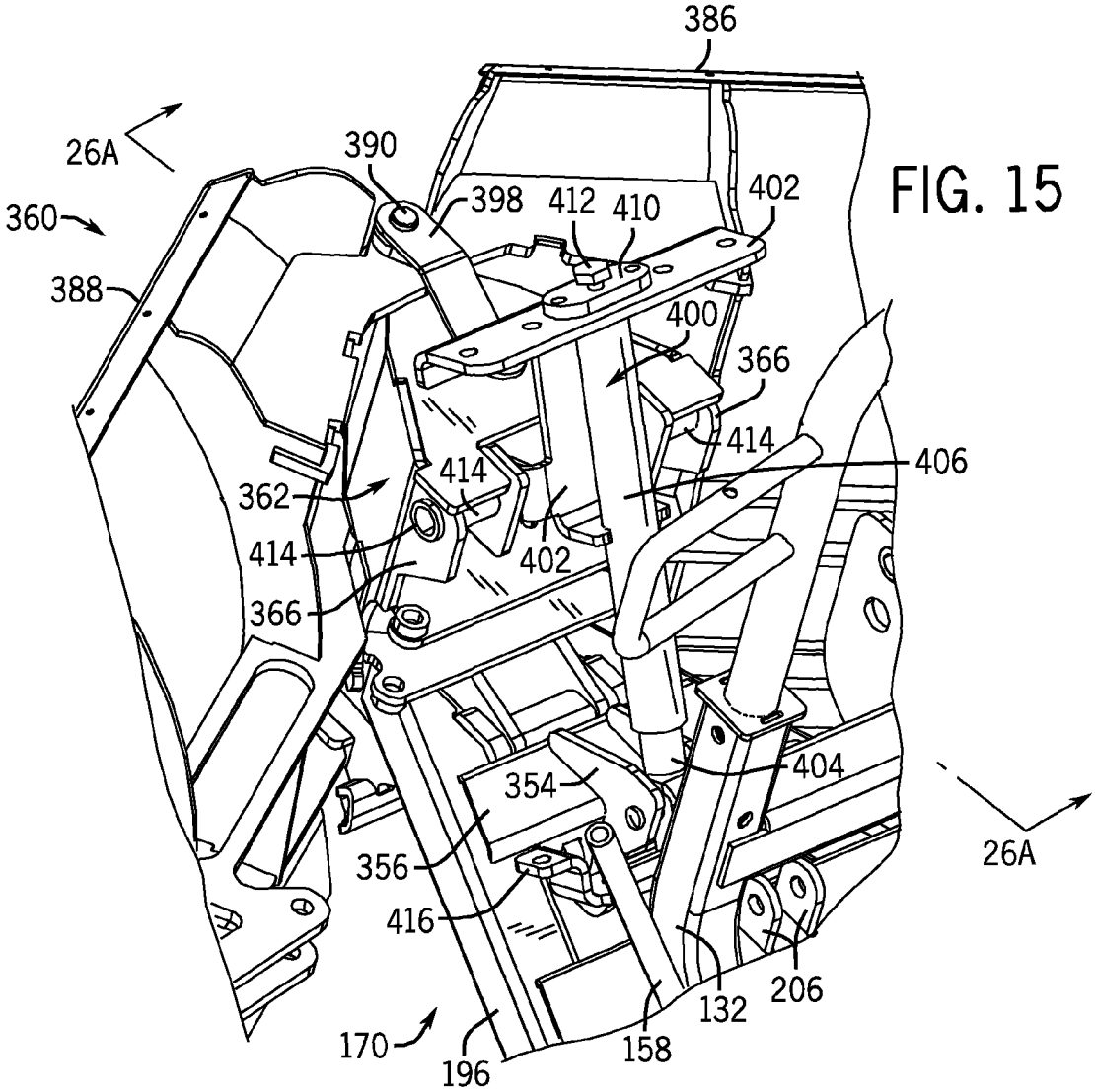
FIG. 15 is a partial rear view of an exemplary embodiment of a plow tower and tower adjustment assembly of the hitch mechanism illustrated in FIG. 3.

A pair of lower tower adjustment brackets 354 are coupled, for example by welding, to the tower traverse brace tube 354. A lower trip spring bracket 416 is coupled to the lower tower adjustment brackets 354. See FIGS. 13, 14 and 23.

Coupled to the traverse brace tube 200 are lift cylinder mounts 206. Lift cylinder mounts 206 are aligned to couple the lower end of the lift cylinder 142 which is coupled to the upper lift cylinder mount 140 on the lift bar 134.

Each of the side members 196, 198 of the plow frame 170 include an adjustment lug 172 at the rear portion 177 of the plow frame 170. Each adjustment lug 172 includes a plurality of orifices 179 aligned vertically and configured to receive a bolt 232 which will couple the plow frame 170 to the lift bar lugs 138 on the lift bar assembly 130. As best seen in FIGS. 12, 12A, 12B, and 12C, the adjustment lug 172 is received between each of the lift bar lugs 138 of the lift bar assembly 130 and secured with a bolt 232. In order to adjust the plow frame height relative to the vehicle, an operator will select one of the vertical adjustment orifices 179 to properly align the plow frame 170 with the lift bar assembly 130 which is in turn coupled with the chassis couplers 108 of the hitch frame nose assembly 100.

Referring now to FIGS. 15-18, there is disclosed a plow tower 362 which is rotatably coupled to the front portion 175 of the plow frame 170. The plow tower 362 is received between the two horizontal blade pivot brackets 350 and coupled to the plow frame 170 with a horizontal blade pivot pin 370 co-axial with and inserted through the horizontal pivot orifice 352 defined in each of the horizontal blade pivot brackets and the orifices 368 defined in the plow tower 362.

Figure 17:
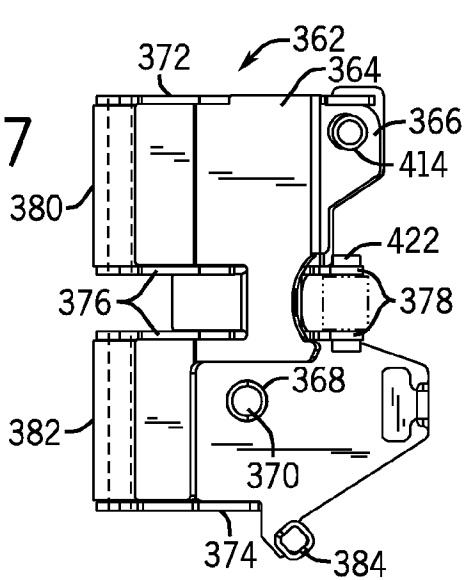
FIG. 17 is a side plan view of an exemplary embodiment of the plow tower illustrated in FIG. 16.
Figure 16:
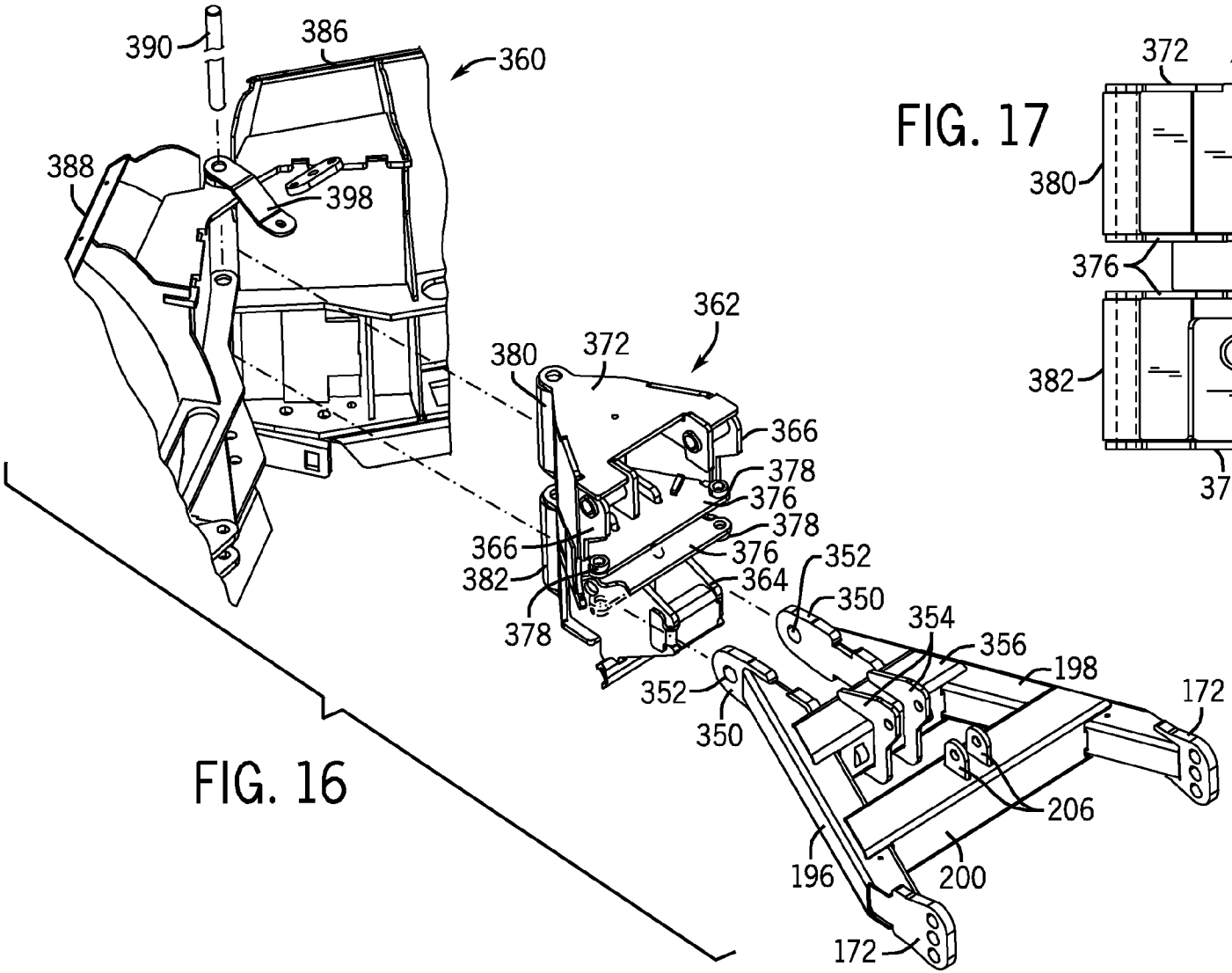
FIG. 16 is an exploded view of the plow frame, plow tower and portions of first and second V-blades illustrated in FIG. 15.
Figure 18:
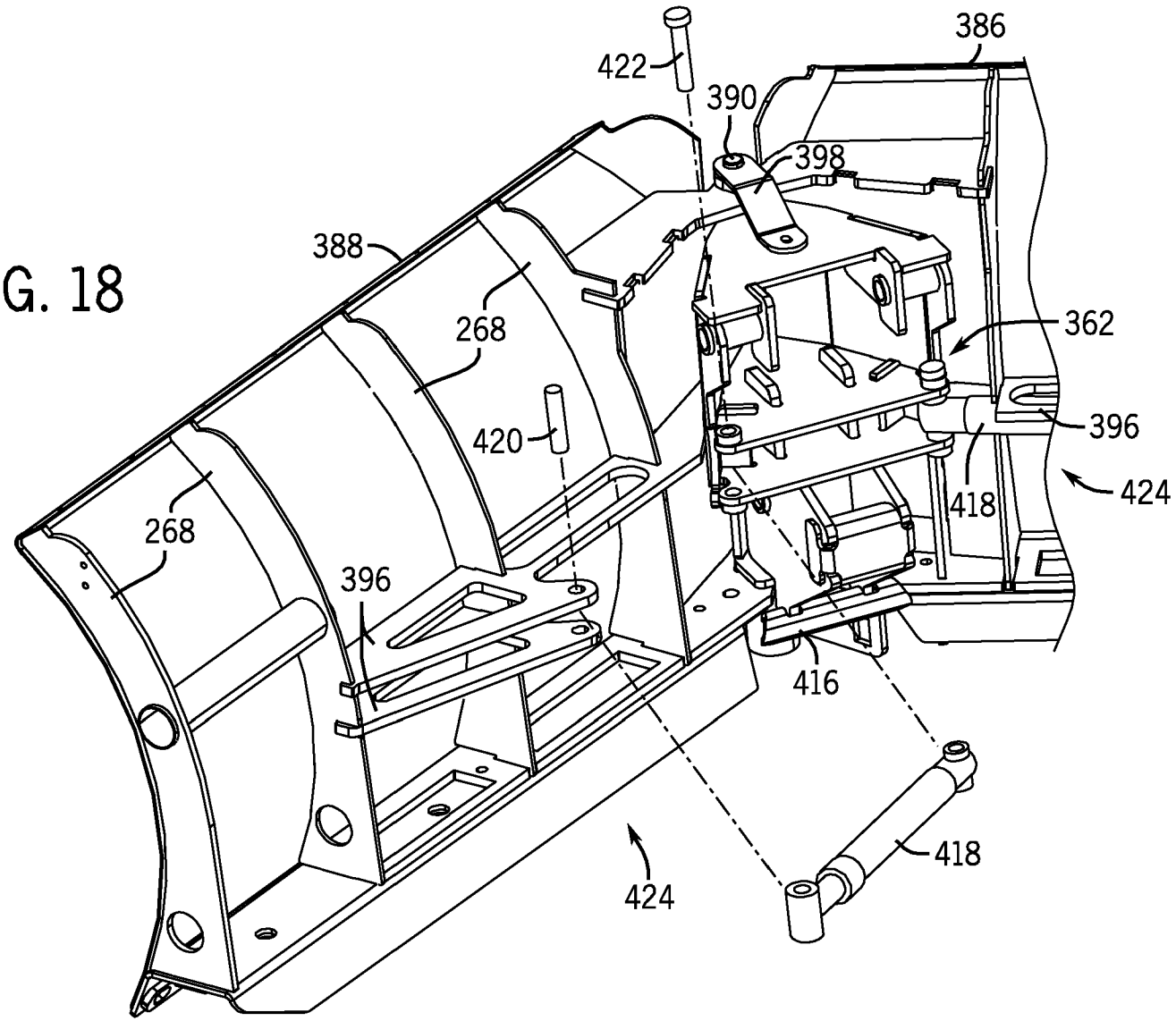
FIG. 18 is an isometric, rear view of one V-plow blade and partial V-plow blade coupled to the plow tower illustrated in FIG. 17 and illustrating an exemplary embodiment of a V-blade actuator.

The plow tower 362 is an assembly of two side plates 364 which are maintained in a triangular configuration by a top plate 372, a lower plate 374 and a pair of intermediate plates 376 as best illustrated in FIGS. 16, 17 and 18. Each of the side plates 364 further define an upper tower adjustment bracket 366, a blade stop 384 and the previously mentioned orifice 368 for the horizontal blade pivot in 370. Coupled between the upper plate 372 and one of the intermediate plates 376 is a blade upper vertical pivot tube 380. Coupled between the lower plate 374 and one of the intermediate blade plates 376 is a lower vertical pivot tube 382. Each of the vertical pivot tubes 380, 382 are coaxial and are positioned at the apex of the triangular-shaped plates, 372, 374, 376. Each of the intermediate plates 376 further define a V-blade swing cylinder bracket 378 which is configured to receive one end of a V-blade swing cylinder 418 and a V-blade swing cylinder pin 422. (See FIG. 17).

A first V-plow blade 386 and a second V-plow blade 388 are coupled together with a blade vertical pivot pin 390 which is received in each of the blade upper vertical pivot tube 380 and lower vertical pivot tube 382. A blade pivot pin tower strap 398 is coupled to the blade vertical pivot pin 390 and the top plate 372 of the plow tower 362.

Figure 24:
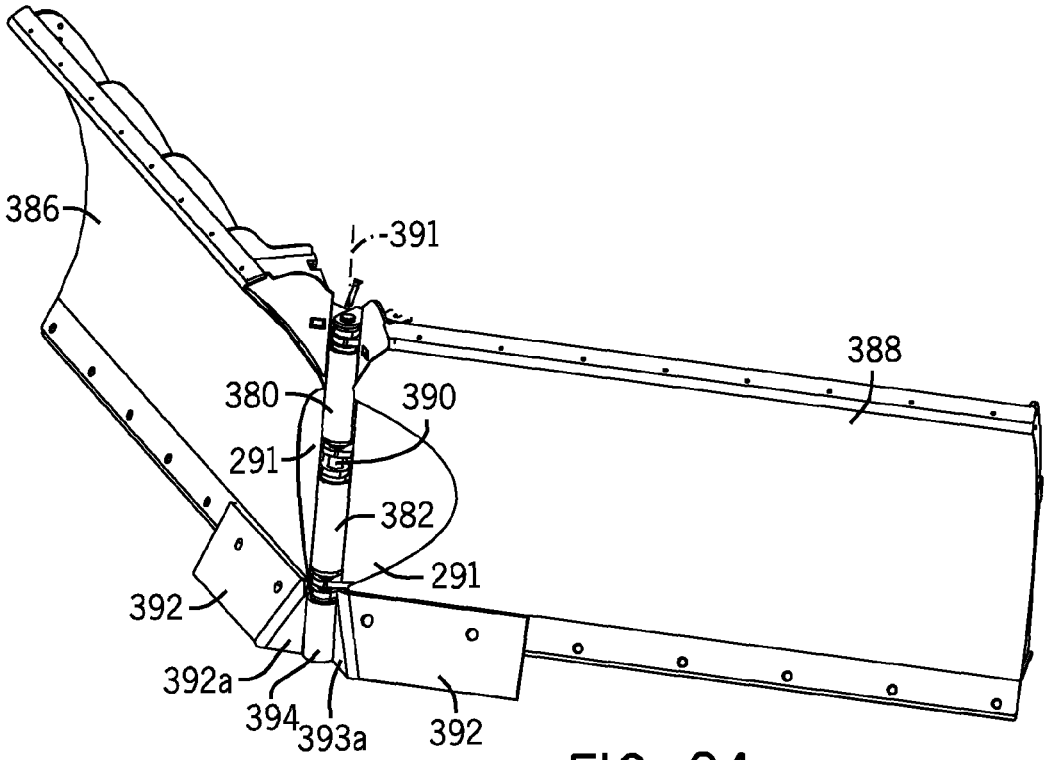
FIG. 24 is an isometric front view of the V-plow blade illustrated in FIG. 23.
Figure 25:
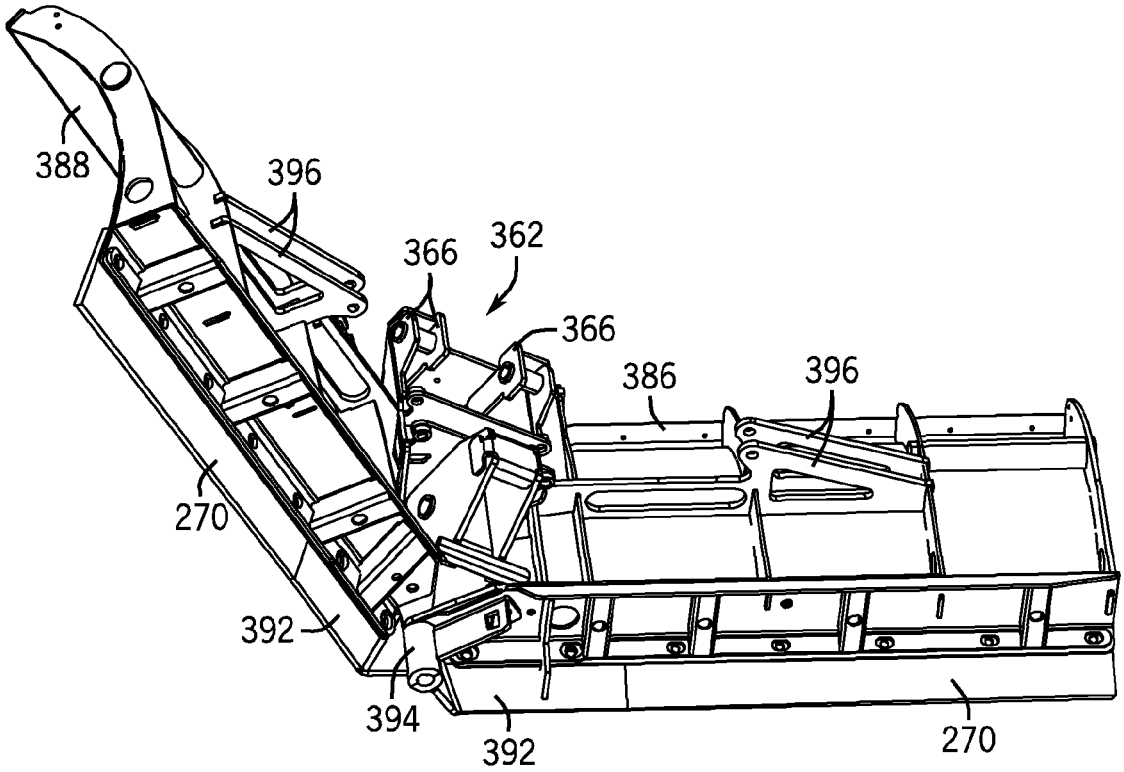
FIG. 25 is an isometric bottom, rear view of the V-plow blade illustrated in FIG. 24.

In a preferred embodiment the blade vertical pivot pin 390 is welded to the blade pivot pin tower strap 398. The orientation of the two V-plow blades 386 and 388 and the vertical pivot tubes 380 and 382 as seen at least in FIGS. 19 and 24 minimize a gap formed between the two blade segments 386, 388. This minimization of the gap inhibits material passing between the blades without requiring an overlap of the two blade segments or providing a cover in front of the hinge formed by the blade vertical pivot pin and the vertical pivot tubes 380, 382.

Each of the V-plow blades 386, 388 include a V-blade actuator 424 which moves each of the V-plow blades 386, 388 into positions as determined by an operator of the snow plow 50.

Each of the V-plow blade actuators 424 include a pair of blade swing cylinder brackets 396 which are coupled to the respective V-plow blades 386, 388. One end of the swing cylinder 418 is coupled to the blade swing cylinder bracket 396 by a cylinder pivot pin 420. Another end of the swing cylinder 418 is coupled between each of the intermediate plates 376 by the V-blade swing cylinder pin 422. A fluid supply system (not shown) is coupled to each of the swing cylinders and other power actuators related to the snow plow 50. A preferred embodiment utilizes hydraulic fluid and cylinders.

FIG. 19 is a detailed view of the front of the V-plow assembly 360. A V-wearstrip 392 is coupled to each of the first and second V-plow blades 386, 388 approximate the center portion of the blade assembly. The V-wearstrip tube 394 is coupled to one of the V-wearstrips 392. It is contemplated that the wearstrip coupled to the tube 394 can be fabricated as part of the V-wearstrip 392 or it can be coupled to a V-wear 392 by, for example, welding. Each of the V-wearstrips 392 are bolted to each of the V-plow blades 386, 388. The blade vertical pivot pin 390 extends into the wearstrip through the tube 394 which completes the hinge for the two V-plow blades 386, 388.

Each of the swing cylinders 418 can move each of the V-plow blades 386, 388 into various configurations as determined by an operator of the snow plow 50. FIG. 20 is a cross-sectional top view through the line 20-20 as illustrated in FIG. 19 which shows the V-wearstrips 392 coupled to each of the V-plow blades 386, 387 with the plow blades in a swept back relationship.

FIG. 20 is the cross-sectional top view of the V-plow blades 386, 387 in a straight configuration. FIG. 22 is a cross-sectional top view of the V-plow blades 386, 388 in a swept forward configuration.

It should be noted that in each of the exemplary illustrated plow blade configurations shown in FIGS. 20, 21 and 22 the gap between the plow blades 386, 388 is minimal and effectively inhibits passage of material between the blade segments as the snow plow 50 is moved forward by the vehicle.

Figure 23:
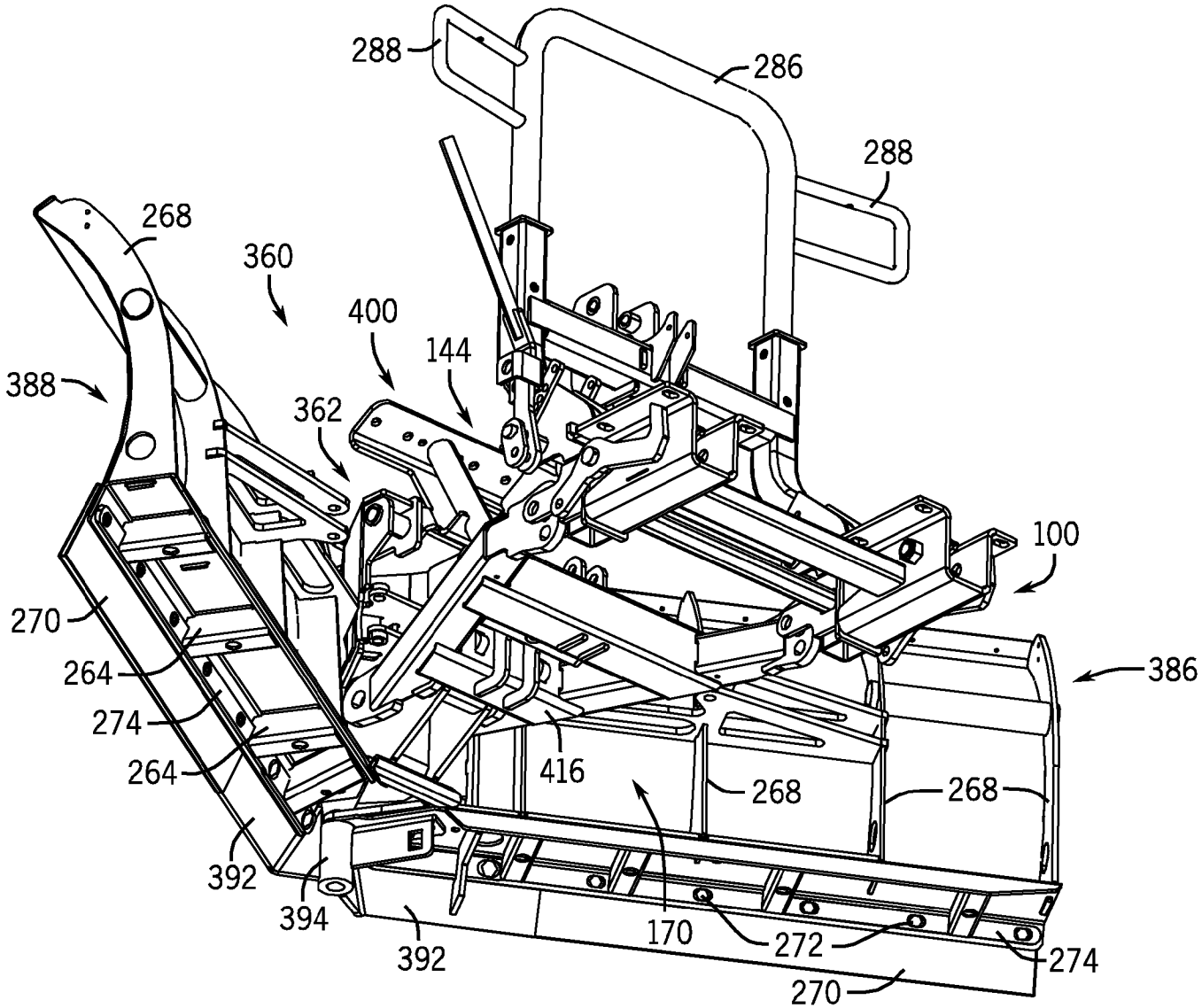
FIG. 23 is an isometric, back view of an exemplary embodiment of a V-plow coupled to the hitch mechanism illustrated in FIG. 3.

FIG. 23 is rear isometric view of simply the body of a V-plow snow plow 50. Each of the V-plow blades 386, 388 includes a plurality of plow ribs 268. Each of the plow ribs 268 are aligned vertically and coupled to a bottom plow frame member 262. The plow ribs 268 are positioned in evenly spaced intervals along the bottom plow frame member 262 and welded to the plow blade 250 in the bottom plow framed member. Each of the plow ribs 268 is configured in a concave curve to which the plow blade rib 286 conforms and which also facilitates movement of material, such as snow, as the plow 50 is operated. A wearstrip 270 is coupled to a substantial portion of the lower edge of each of the V-plow blades by a plurality of bolts 272 which extends through the wearstrip 270, the plow blade, the bottom plow frame member 262 and a nut plate 274 which is positioned against one of the downward extending flanges of the bottom plow frame member 262 (see at least FIG. 23). Reinforcement members 264 are positioned between the down facing flanges of the bottom plow frame member to reinforce the plow blade assembly. The reinforcement members 264 are typically welded to the bottom plow frame member 262. The top edge of the plow blade is bent and configured to be coupled to the top edge of each of the plow ribs 268. The top edge of the plow blade is typically welded to each of the plow ribs 268. As illustrated at least in FIGS. 15, 26*b* and 27 a tower adjustment assembly 400 is coupled to the plow tower 362 and the plow frame 170.

The tower adjustment assembly 400 includes a tower adjustment bracket 402 which is in a substantial T-shape. The top portion of the T-shape tower adjustment bracket 402 is coupled to an outer adjustment tube 406 at one end of the outer adjustment tube 406 and the lower portion of the T-shaped tower adjustment bracket 402 is also coupled to the outer adjustment tube 406 and is pivotally coupled to the plow tower 362 at the upper tower adjustment bracket 366 (see FIG. 17). A tower adjustment pin 414 secures the T-shape tower adjustment bracket 402 on each side of the plow tower 362. An inner adjustment tube 404 is telescopically inserted into the outer adjustment tube 406 with the lower end of the inner adjustment tube 404 coupled to the lower tower adjustment bracket 354 on the tower traverse brace tube 356. The inner adjustment tube 404 does not extend throughout the full length of the outer adjustment tube 406. An adjustment cushion plug 408 is configured to fit within the inner diameter of the outer adjustment tube 406 and is inserted into the outer adjustment tube 406 between the inner adjustment tube 404 and a bolt bracket 410 coupled to the T-shape tower adjustment bracket 402. An adjustment bolt 412 is threadingly coupled to the adjustment cushion plug 408 through the bolt bracket 410. An accuator may be coupled to the adjustment bolt 412 to facilitate the operation discussed below. The actuator can be manual or powered. A powered actuator can be a pneumatic cylinder, hydraulic cylinder or an electric motor. The power actuator will include appropriate controls which may be operated from the vehicle. The adjustment cushion plug 408 is preferably composed of a high density material such as polyurethane or other high density material.

Figure 26B:
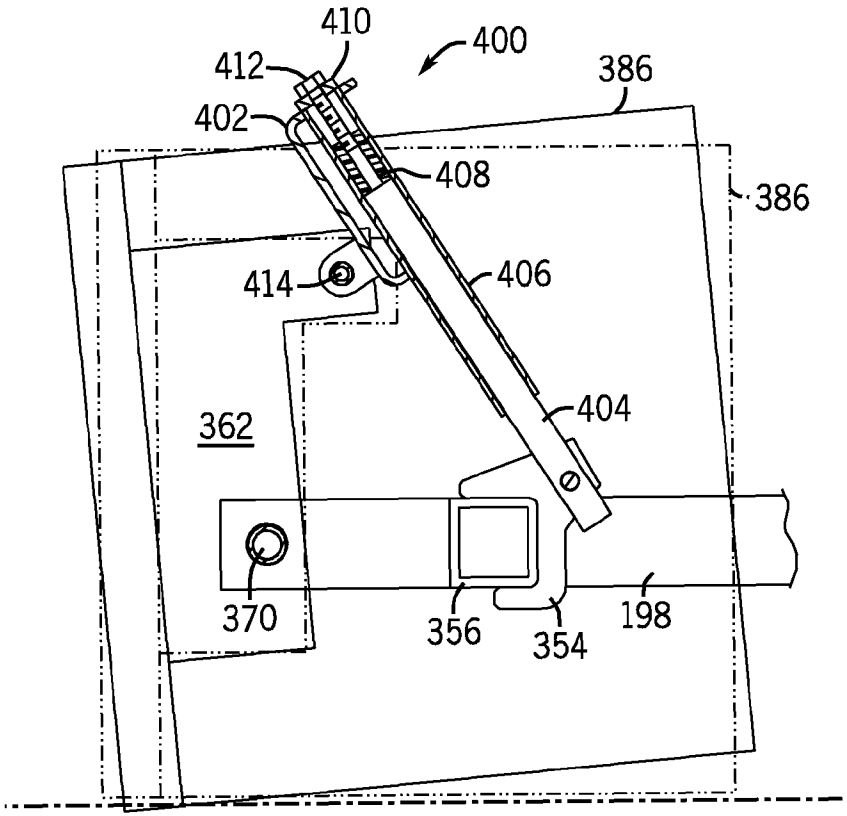
FIG. 26B is a schematic of the tower adjustment assembly rotating the V-plow blade about a horizontal blade pivot pin in the plow tower illustrated in FIG. 26A.
Figure 26A:
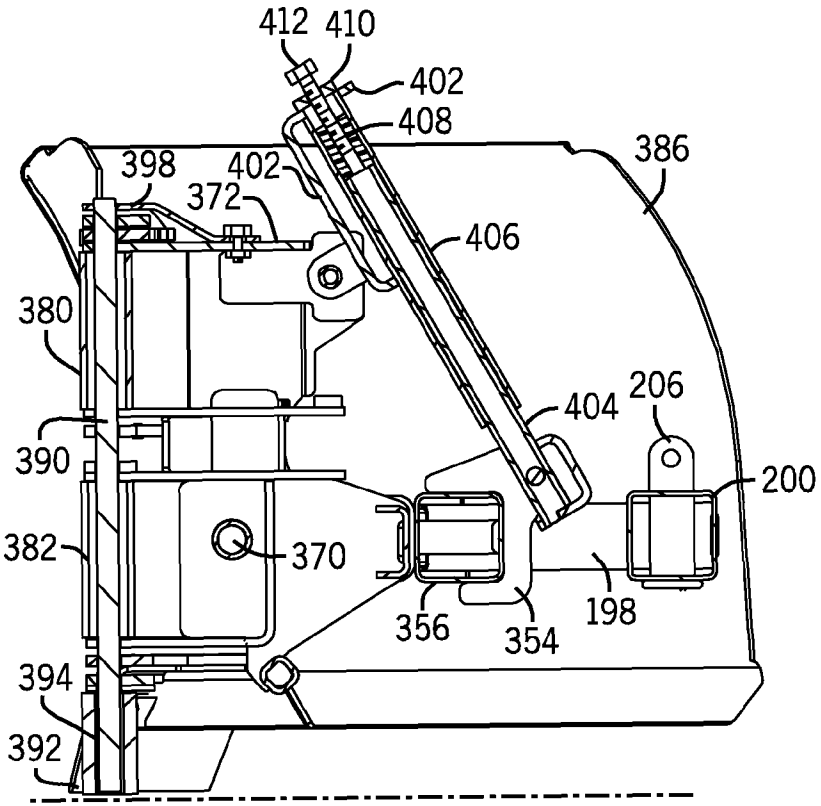
FIG. 26A is a cross sectional view along the line 26A-26A in FIG. 15 and illustrating the tower and tower adjustment assembly for a V-plow blade to maintain the lower edge of the blades in a horizontal aspect relative to the surface being cleaned.

In operation, for example, as the adjustment bolt 412 is turned, clockwise, into the inner and outer adjustment tube assembly the adjustment bolt 412 pushes against the adjustment cushion plug 408 transmitting a force that forces the V-plow blades 386, 388 to pivot about the horizontal pivot pin 370 as illustrated schematically in FIG. 26*b*. The purpose of such adjustment is to position the V-plow blades relative to the work surface and maintain the lower edges of each of the V-plow blades 386, 388 in a substantially horizontal relationship to the surface which is being cleared of material by the plow 50. As the two segments of the V-plow are moved to various configurations (as described above) the outermost ends of each of the V-plows tend to move vertically relative to the plow hinge central section. The tower adjustment assembly counteracts such vertical movement and facilitates maintenance of a horizontal aspect of the lower edge of each of the blade segments.

Figure 27:
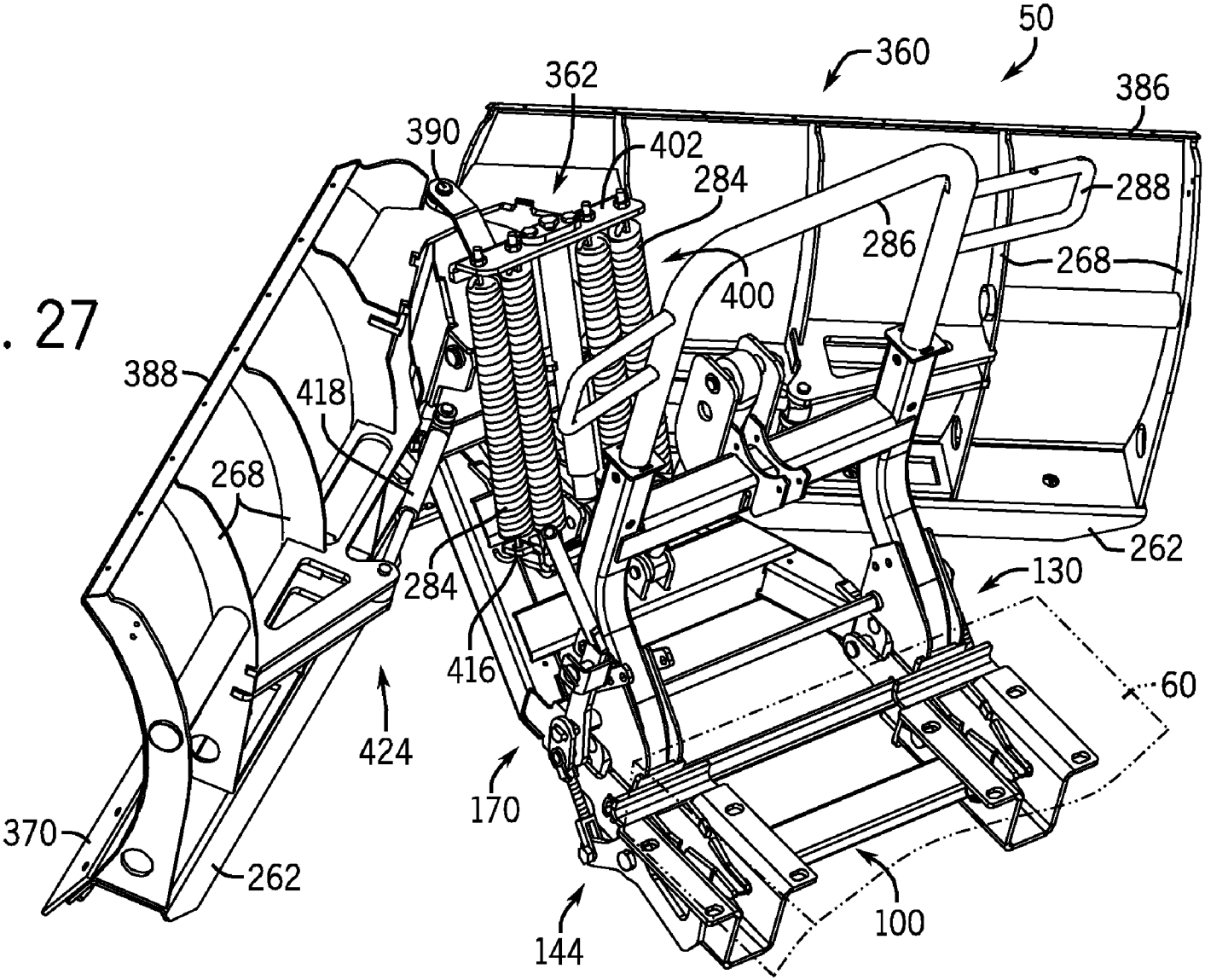
FIG. 27 is an isometric, assembly top view of an exemplary embodiment of the blade illustrated in FIG. 23.

As illustrated in FIG. 27, a plurality of trip springs 284 are coupled to each of the lower trip spring brackets 416 and the tower adjustment bracket 402. FIG. 27 also illustrates a light bar 286 coupled to the lift bar support brackets 132. The light bar 286 supports a plurality of light brackets 288 to which plow lights (not shown) are coupled. Plow lights are typically needed since the snow plow 50 typically obstructs the headlights of the vehicle to which the snow plow is coupled. The trip springs 284 bias the plow tower 362 during operation of the plow 50 to return the V-plow blades 386, 388 to their operative position after the plow blade encounters an obstruction in the surface being cleared.

For purposes of this disclosure, the term "coupled" means the joining of two components (electrical or mechanical) directly or indirectly to one another. Such joining may be stationary in nature or moveable in nature. Such joining may be achieved with the two components (electrical or mechanical) and any additional intermediate members being integrally formed as a single unitary body with one another or the two components and any additional member being attached to one another. Such adjoining may be permanent in nature or alternatively be removable or releasable in nature.

Although the foregoing description of a quick connect/disconnect hitch and a plow with independently moveable wings has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the hitch or plow as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A V-plow, comprising:

a first V-plow blade;

a second V-plow blade;

said first and second V-plow blades having a horizontal axis; and a plow tower coupled to each of the V-plow blades and including a tower adjustment assembly;

said tower adjustment assembly comprising an inner adjustment tube, partially telescopically inserted into an outer adjustment tube;

the outer adjustment tube pivotally coupled to the plow tower of the V-plow and coupled to a tower adjustment bracket;

an adjustment cushion plug configured to fit within the inner diameter of the outer adjustment tube;

the adjustment cushion plug positioned within the outer adjustment tube in operative contact with the inner adjustment tube; and an adjustment bolt threadingly coupled to the adjustment cushion plug;

wherein upon compression of the adjustment cushion plug with the adjustment bolt a force is transmitted to the inner adjustment tube, rotating the plow tower about the horizontal axis and moving the two V-plow blades to a position.

2. The V-plow of claim 1, wherein the tower adjustment assembly is substantially T-shaped.

3. The V-plow of claim 1, further comprising a plurality of trip springs coupled to the tower adjustment bracket and configured to bias the plow tower during operation of the V-plow.

4. The V-plow of claim 3, wherein the plurality of trip springs are configured to return at least one blade of the V-plow to an operative configuration of the blade.

5. The V-plow of claim 1, wherein the adjustment bolt is configured to maintain a lower edge of at least one of the V-plow blades in a substantially horizontal relationship to a working surface.

6. The V-plow of claim 1, wherein the adjustment bolt is configured such that upon tightening of the adjustment bolt, the adjustment cushion plug is compressed and the plow tower rotates in a first direction about the horizontal axis, and upon loosening of the adjustment bolt, the adjustment cushion plug is decompressed and the plow tower rotates in a second direction, opposite the first direction, about the horizontal axis.

7. A method for maintaining blades of a V-plow in a substantially horizontal relationship to a working surface, the V-plow including a first V-plow blade and a second V-plow blade, each pivotally coupled to a plow tower with a horizontal pivot pin, the method comprising:

providing a tower adjustment assembly, the tower adjustment assembly including an outer adjustment tube and an adjustment cushion plug;

configuring the adjustment cushion plug within the outer adjustment tube;

coupling the outer adjustment tube to the plow tower;

compressing the adjustment cushion plug;

wherein the compressing causes the V-plow blades to rotate about the horizontal pivot pin in a first direction.

8. The method of claim 7, further comprising decompressing the adjustment cushion plug;

wherein the decompressing causes the V-plow blade to rotate about the horizontal pivot pin in a second direction, opposite the first direction.

9. The method of claim 7, further comprising using an adjustment bolt to compress the adjustment cushion plug.

10. A tower adjustment assembly for a snow plow, the snow plow including a hitch frame nose assembly configured to couple to a vehicle, the hitch frame nose assembly including a chassis coupler secured at each end of a chassis tube with each chassis coupler including a traverse pin and configured to attach to the vehicle chassis, a plow frame having a front portion and a rear portion, and a first V-plow blade and a second V-plow blade, each pivotally coupled to a plow tower with a horizontal pivot pin, the plow tower configured to support each of the V-plow blades for movement about a blade vertical pivot pin disposed in each of the first and second V-plow blade and the plow tower, the a tower adjustment assembly comprising:

an inner adjustment tube, partially telescopically inserted into an outer adjustment tube;

the outer adjustment tube pivotally coupled to the plow tower of the V-plow and coupled to a tower adjustment bracket;

an adjustment cushion plug configured to fit within the diameter of the outer adjustment tube;

the adjustment cushion plug positioned within the outer adjustment tube in operative contact with the inner adjustment tube;

a bolt bracket, the bolt bracket coupled to the tower adjustment bracket;

an adjustment bolt;

the adjustment cushion plug positioned between the inner adjustment tube and the adjustment bolt;

the adjustment bolt threadingly coupled to the adjustment cushion plug through the bolt bracket; wherein upon compression of the adjustment cushion plug a force is transmitted to the inner adjustment tube, rotating the plow tower about the horizontal pivot pin.

11. The tower adjustment assembly of claim 10, wherein the tower adjustment bracket is substantially T-shaped.

12. The tower adjustment assembly of claim 10, wherein the adjustment cushion plug is composed of a high density material.

13. The tower adjustment assembly for a snow plow of claim 12, wherein the high density material is polyurethane.

14. The tower adjustment assembly of claim 10, further comprising a plurality of trip springs coupled to the tower adjustment pivot bracket and configured to bias the plow tower during operation of the V-plow.

15. The tower adjustment assembly of claim 14, wherein the plurality of trip springs are configured to return at least one blade of the V-plow to an operative configuration of the blade.

16. The tower adjustment assembly of claim 10, wherein the adjustment bolt is configured to maintain a lower edge of at least one V-plow blade in a substantially horizontal relationship to a working surface.

17. The tower adjustment assembly of claim 10, wherein the adjustment bolt is configured such that upon tightening of the adjustment bolt, the adjustment cushion plug is compressed and the plow tower rotates in a first direction about the horizontal pivot pin, and upon loosening of the adjustment bolt, the adjustment cushion plug is decompressed and the plow tower rotates in a second direction, opposite the first direction, about the horizontal pivot pin.

18. An apparatus to position V-plow blades relative to a work surface, a V-plow including a plow frame, a first blade and a second blade, each blade rotatable about a horizontal axis, the apparatus to position comprising:

a tower coupled to each of the first and second blade with a horizontal pivot pin co-axial with the horizontal axis, and the plow frame, wherein the tower defines a vertical axis; and a tower adjustment assembly coupled to the tower and to the plow frame, the tower adjustment assembly including an adjustment cushion plug, wherein the adjustment cushion plug is configured to transmit a force through the tower adjustment assembly to rotate the tower about the horizontal axis and move the first and second blade to a horizontal position relative to the work surface.

19. The apparatus to position of claim 18, wherein the tower adjustment assembly includes an inner adjustment tube and an outer adjustment tube telescopically coupled together and configured to receive the adjustment cushion plug, with the adjustment cushion plug coupled to an adjustment bolt configured to move the adjustment cushion plug within the outer adjustment tube against the inner adjustment tube.

20. The apparatus to position of claim 19, wherein the adjustment bolt is configured such that upon tightening of the adjustment bolt, the adjustment cushion plug is compressed and the plow tower rotates in a first direction about the horizontal axis, and upon loosening of the adjustment bolt, the adjustment cushion plug is decompressed and the plow tower rotates in a second direction, opposite the first direction about the horizontal axis.

21. The apparatus to position of claim 18, further comprising a plurality of trip springs coupled to the tower and the plow frame and configured to bias the plow tower toward the plow frame.

22. The apparatus to position of claim 18, including an actuator coupled to the adjustment bolt and configured to move the bolt a select direction.

23. The apparatus to position of claim 22, wherein the actuator is one of a manual actuator and powered actuator.

24. The apparatus to position of claim 23, wherein the powered actuator is one of a pneumatic cylinder, hydraulic cylinder and an electric motor.

* * * * *

UNITED STATES PATENT AND TRADEMARK OFFICE

CERTIFICATE OF CORRECTION

PATENT NO. : 7,836,613 B2
APPLICATION NO. : 12/485351
DATED : November 23, 2010
INVENTOR(S) : Timothy G. Koch et al.

It is certified that error appears in the above-identified patent and that said Letters Patent is hereby corrected as shown below:

Column 5, Line 54:
"unshaped" should read --u-shaped--.

Signed and Sealed this
Nineteenth Day of July, 2011

David J. Kappos
*Director of the United States Patent and Trademark Office*